US006454379B1

(12) United States Patent
Taneya et al.

(10) Patent No.: US 6,454,379 B1
(45) Date of Patent: Sep. 24, 2002

(54) LIQUID DISCHARGE HEAD AND LIQUID DISCHARGE APPARATUS THAT USES THE LIQUID DISCHARGE HEAD, AND DISCHARGE VOLUME CORRECTION METHOD FOR THE LIQUID DISCHARGE HEAD

(75) Inventors: Yoichi Taneya, Yokohama; Akihiro Yamanaka; Yoshiyuki Imanaka, both of Kawasaki; Masahiko Kubota, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/584,484

(22) Filed: Jun. 1, 2000

(30) Foreign Application Priority Data

Jun. 4, 1999 (JP) ..... 11-158362

(51) Int. Cl.[7] ..... B41J 2/05
(52) U.S. Cl. ..... 347/19; 347/48; 347/65
(58) Field of Search ..... 347/19, 6, 5, 56, 347/65, 48, 60; 73/202.5, 204.11, 861

(56) References Cited

U.S. PATENT DOCUMENTS

| | | | | | |
|---|---|---|---|---|---|
| 4,723,129 A | | 2/1988 | Endo et al. | 346/1.1 |
| 5,108,193 A | * | 4/1992 | Furubayashi | 73/204.11 |
| 5,389,957 A | * | 2/1995 | Kimura et al. | 347/20 |
| 5,726,690 A | * | 3/1998 | Bohorquez et al. | 347/19 |
| 5,815,175 A | | 9/1998 | Seikel | 349/23 |
| 5,869,758 A | * | 2/1999 | Huiberts | 73/204.11 |
| 5,936,156 A | * | 8/1999 | Roberts et al. | 73/202.5 |
| 5,992,769 A | * | 11/1999 | Wise et al. | 347/65 |
| 6,062,678 A | | 5/2000 | Ishinaga et al. | 347/62 |
| 6,183,056 B1 | * | 2/2001 | Corrigan et al. | 347/19 |

FOREIGN PATENT DOCUMENTS

| | | | | |
|---|---|---|---|---|
| EP | 661162 A2 | | 7/1995 | |
| EP | 08150713 | | 6/1996 | |
| EP | 767063 A1 | | 4/1997 | |
| EP | 811490 A2 | | 12/1997 | |
| JP | 10-29321 | | 3/1998 | |
| WO | WO-94/10540 A1 | * | 5/1994 | G01F/7/00 |

* cited by examiner

*Primary Examiner*—Craig A. Hallacher
(74) *Attorney, Agent, or Firm*—Fitzpatrick, Cella, Harper & Scinto

(57) ABSTRACT

A liquid discharge head includes an element substrate on whose surface a plurality of energy generation elements are arranged in parallel to generate electrical energy that is applied to eject a liquid, a top plate positioned facing the element substrate and defining a plurality of liquid flow paths that correspond to the energy generation elements and that communicate with discharge orifices from which liquid is ejected, one or more flow rate detection elements, which are provided for each of the liquid flow paths to detect the flow rate at which the liquid flows along each of the liquid flow paths, and an energy generation element controller for controlling the conditions under which the energy generation elements are driven, based on the results output by the flow rate detection elements.

21 Claims, 18 Drawing Sheets

LIQUID DISCHARGE HEAD AND LIQUID DISCHARGE APPARATUS THAT USES THE LIQUID DISCHARGE HEAD, AND DISCHARGE VOLUME CORRECTION METHOD FOR THE LIQUID DISCHARGE HEAD

BACKGROUND OF THE INVENTION

1. Field of the Invention

The present invention relates to a liquid discharge head, which to discharge a desired liquid generates bubbles by applying thermal energy to the liquid, and a liquid discharge apparatus that uses the liquid discharge head, and to a method for correcting the volume of liquid discharged by the liquid discharge head.

The present invention can be applied for an apparatus such as a printer, a copier, a facsimile machine that includes a communication system, or a word processor for which is provided a printing unit, which records data on a recording medium composed, for example, of paper, thread, fiber, cloth, metal, plastic, glass, wood or a ceramic material, or for an industrial recording unit that when assembled includes one or more of the above variety of apparatuses.

"Recording" according to this invention applies not only to the provision for a recording medium of meaningful images, such as characters or graphics, but also to the provision of meaningless images, such as random patterns.

2. Related Background Art

A conventional, well known ink-jet recording method is the so-called bubble-jet recording process, according to which a state change occurs when thermal energy applied to a water-based liquid produces a drastic change in liquid volume (bubbles are generated), and liquid droplets are ejected through discharge orifices and adhere to and form an image on a recording medium. As is disclosed in U.S. Pat. No. 4,723,129, for a recording apparatus employing the bubble-jet recording process, a liquid discharge head that is generally provided comprises: discharge orifices for discharging a liquid; liquid flow paths that communicate with the discharge orifices; and electro-thermal conversion elements provided along the liquid flow paths that serve as energy generation means for discharging the liquid.

According to this recording method, a high quality image can be recorded rapidly with reduced noise, and in the liquid discharge head, the discharge orifices can be assembled to form a high density arrangement. As a result, many outstanding advantages are provided, to include the capabilities of recording high resolution images using a compact apparatus and of performing the easy recording of color images. Therefore, the bubble-jet recording process is employed for many office machines, such as printers, copiers and facsimile machines, and in addition, is employed in industry, such as when it is used in a printing apparatus for textiles.

For the above described liquid discharge head, however, the volume of the liquid ejected from the discharge orifices differs due to production errors during their preparation, and these variances in the volume of the discharged liquid must thereafter be corrected during the remainder of the head manufacturing process. That is, to eliminate the variances, liquid from all the orifices is ejected onto a recording medium, and the dot diameters of the ejected liquid are examined to calculate the volume of the liquid discharged by each discharge orifice. Then, correction data to regulate the fluid discharged are written to a ROM.

When the variances in the volume of the liquid discharged from the discharge orifices are corrected as described above, by actually ejecting liquid during the manufacturing process, immediately after the corrections are made the liquid volume variances are eliminated. However, after some time has elapsed following the corrections, and water in the liquid has evaporated, the effectiveness of the corrections is reduced due to an increase in the viscosity of the liquid. Therefore, over an extended period of time, it is difficult to use small droplets to form high quality images, a procedure that is currently in demand. In addition, while a process can be performed that, to a degree, restores the effectiveness of the variance corrections, this recovery process must be performed frequently. And as a result, not only is throughput reduced, but also, since ink tank capacity must be increased, a compact apparatus can not be obtained.

SUMMARY OF THE INVENTION

It is, therefore, one objective of the present invention to provide a liquid discharge head that can form high-quality images for an extended period of time and a liquid discharge apparatus that can use the liquid discharge head, and a discharge volume correction method for the liquid discharge head.

To achieve the above objective, according to the present invention, a liquid discharge head comprises:

- an element substrate, on the surface of which a plurality of energy generation elements are arranged in parallel to generate electrical energy that is applied to eject a liquid;
- a top plate, which is positioned facing the element substrate and which defines a plurality of liquid flow paths that correspond to the energy generation elements and that communicate with discharge orifices whereat a liquid is ejected;
- one or more flow rate detection elements, which are provided for each of the liquid flow paths to detect the flow rate at which the liquid flows along each of the liquid flow paths; and
- an energy generation element controller, for controlling, based on the results output by the flow rate detection elements, the condition under which the energy generation elements are driven.

The flow rate detection elements are provided on the liquid flow paths upstream of the energy generation elements.

The flow rate detection elements each include a heat generator and a temperature detector for flow rate detection.

The flow rate detection elements are thermistors.

The flow rate is detected by heating the heat generator before the application of the electrical energy, and by detecting a temperature using the temperature detector after the application of the electrical energy.

The electrical energy is applied as a plurality of pulses.

The condition for the driving of the energy generation elements may be controlled for each of the liquid flow paths, or may be controlled by changing the pulse width of a drive pulse to be applied to each of the energy generation elements.

Further, the condition for driving the energy generation elements may be controlled by driving sub-heaters that are provided for the liquid discharge head and heating the liquid in the liquid flow paths.

The energy generation elements are electro-thermal conversion elements that generate thermal energy for generating bubbles.

Movable members are located along the liquid flow paths, facing the energy generation elements, so that the downstream ends thereof, which are directed toward the discharge orifices, move freely, and the flow rate detection elements are provided for the movable members.

The flow rate detection elements may be provided for walls of a top plate facing the liquid flowing in the liquid flow paths, or may be provided for walls of the element substrate facing the liquid flowing in the liquid flow paths. Further, the flow rate detection elements may be provided in three-dimensional structures that project outward into the liquid flow paths from walls that define the liquid flow paths.

In addition, according to the present invention, a liquid discharge apparatus comprises:

transportation means for transporting a recording medium; and supporting means for supporting a liquid discharge head, in accordance with the invention, for ejecting a liquid to record an image on the recording medium, and for reciprocally moving perpendicular to the direction in which the recording medium is transported.

According to the present invention, a liquid discharge apparatus may include recovery means for, in accordance with a signal output by each of the flow rate detection elements, performing a recovery process to attract the liquid in the liquid discharge head of the invention.

The words "upstream" and "downstream" are used in this invention to represent the direction in which the liquid flows from a liquid supply source via an bubble generation area (or a movable member) to a discharge orifice, or the direction designated in the above described arrangement.

DETAILED DESCRIPTION OF THE PREFERRED EMBODIMENTS

First Embodiment

An explanation will now be given for a liquid discharge head according to a first embodiment of the present invention, which comprises: a plurality of discharge orifices for ejecting a liquid; a first substrate and a second substrate that are bonded together to form a plurality of liquid flow paths that respectively communicate with the discharge orifices; a plurality of energy conversion elements that are provided in the individual liquid flow paths to convert electrical energy to energy for ejecting the liquid in the liquid flow paths; flow rate detection elements for detecting the flow rate of the liquid in the liquid flow paths; and a plurality of elements or electric circuits that have different functions and are provided to control the driving conditions for the energy conversion elements, wherein, in accordance with the functions, the elements or the electric circuits are sorted out between the first and the second substrate.

Figure 1A:
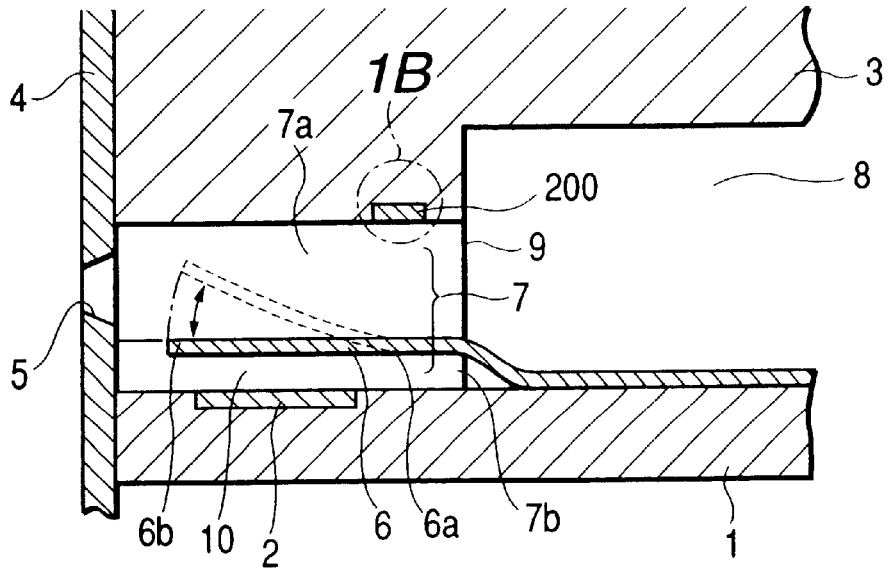
FIGS. 1A and 1B are a cross-sectional view and a partially enlarged view along a liquid flow path for explaining a liquid discharge head structure according to a first embodiment of the present invention.
Figure 1B:
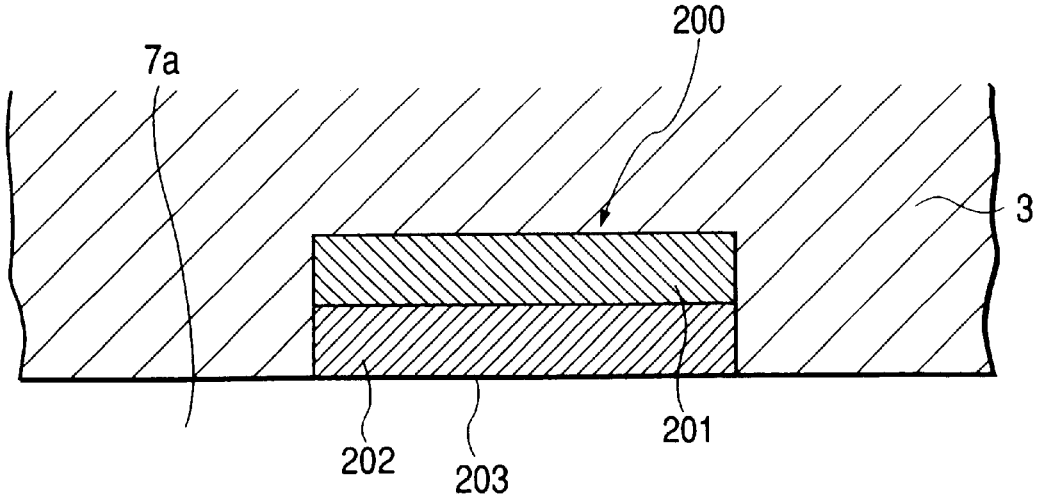

FIG. 1A is a cross-sectional view, taken along a liquid flow path, of the liquid discharge head according to this embodiment, and FIG. 1B is an enlarged diagram showing a portion B in FIG. 1A.

As is shown in FIG. 1A, the liquid discharge head comprises: an element substrate 1, on which multiple discharge heaters 2 (only one heater is shown in FIG. 1A) are arranged in parallel to apply thermal energy to a liquid to generate bubbles therein; a top plate 3, which is bonded to the element substrate 1 and on which multiple flow rate detectors 200 (only one detector is shown in FIG. 1A) are arranged in parallel; an orifice plate 4, which is bonded to the front ends of the element substrate 1 and the top plate 3; and a movable member 6, which is located inside a liquid flow path 7 that is defined by the element substrate 1 and the top plate 3.

The element substrate 1 is provided by depositing a silicon oxide film or a silicon nitride film on a silicon substrate for insulation or heat accumulation, and by patterning, on the resultant structure, wiring and an electric resist layer that constitutes the discharge heaters 2. Then, when a current is supplied to the electric resist layer, by the application of a voltage, the discharge heaters 2 generate heat.

The top plate 3 is used to form multiple liquid flow paths 7, which correspond to the discharge heaters 2, and a common liquid chamber 8, from which a liquid is supplied to the liquid flow paths 7. A flow path side wall 9 is integrally formed and extends from the ceiling to the individual discharge heaters 2. The top plate 3 is made of a silicon material, and is fashioned by using etching to produce on it the patterns of the liquid flow paths 7 and the common liquid chamber 8, or by first employing a well known method, such as the CVD method, to deposit on the silicon substrate a material, such as silicon nitride or silicon oxide, to serve as the flow path side walls 9, and thereafter etching the surface of the silicon substrate to produce the liquid flow paths 7.

In FIG. 1A on the top plate 3, a flow rate detector 200, which measures the rate of flow of the liquid in a first liquid flow path 7*a*, is provided upstream of a discharge heater 2 at a distance whereat the detector 200 is not affected by the heat generated by the discharge heater 2. As is shown in FIG. 1B, the flow rate detector 200 includes a heat generator 201 for flow rate detection, and a temperature detector 202. A temperature detection face 203 of the temperature detector 202 is located on the same plane as the surface of the top plate that faces the first liquid flow path 7*a*. The heat generator 201, which is positioned on the upper face of the temperature detector 202, provides heat to increase the temperature of the temperature detector 202 until it is higher than the temperature of the liquid that is flowing along the first liquid flow path 7*a*.

In order to form the top plate 3, a silicon oxide film or a silicon nitride film, for insulation or heat accumulation, may be deposited on the silicon substrate, and an electrical resist layer, which constitutes the heat generator 201 for flow rate detection, and wiring is patterned on the resultant structure. In this case, when a voltage carried by the wiring is applied to the electrical resist layer, the current flowing through the electrical resist layer produces heat in the heat generator 201. The temperature detector 202, which is laminated on the heat generator 201, may be an element, such as a PN diode or an Al temperature sensor, whose voltage at both ends or whose resistance is changed by heat. The thus structured top plate 3 is then attached to the element substrate 1 with the temperature detector 202 facing the element substrate 1.

The temperature detector 202 may also be a thermistor, a temperature sensor that itself generates heat upon the application of a voltage. In this case, since the thermistor increases its own temperature upon application of a voltage, it can also serve as the heat generator 201, and the structure of the flow rate detector 200 can be simplified.

A plurality of discharge orifices 5 are formed in the orifice plate 4. The discharge orifices 5 correspond to the liquid flow paths 7, and communicate via the liquid flow paths 7 with the common liquid chamber 8. The orifice plate 4 is also made of a silicon material, and is fashioned, for example, by shaving down the silicon substrate 4, in which the discharge orifices 5 are formed, to a thickness of 150 $\mu$m. It should be noted that the orifice plate 4 is not always required for this invention. In the process for forming the liquid flow paths 7 in the top plate, instead of the orifice plate 4 a wall that is equivalent in thickness to the orifice plate 4 can be left at the distal end of the top plate 3, and the discharge orifices 5 can be formed in that wall. As a result, a top plate 3 can be provided in which orifices are formed.

The movable member 6 is a cantilever thin film located opposite the discharge heater 2, so that the liquid flow path 7 is divided into the first liquid flow path 7*a* that communicates with the discharge orifice 5 and the second liquid flow path 7*b* along which the discharge heater 2 is provided. The movable member 6 is made of a silicon material, such as silicon nitride or silicon oxide.

The movable member 6 has a fulcrum 6*a* upstream of a large flow of a liquid that is discharged from the common liquid chamber 8 via the movable member 6 to the discharge orifice 5. The movable member 6 is positioned facing the discharge heater 2 at a predetermined distance so as to cover the discharge heater 2, with that a free end 6*b* placed downstream from the fulcrum 6*a*. The space between the discharge heater 2 and the movable member 6 is defined as an bubble generation area 10.

With this arrangement, when the discharge heater 2 generates heat, the heat acts on the liquid in the bubble generation area 10 between the movable member 6 and the discharge heater 2, and based on a film boiling phenomenon, bubbles are generated and grow on the discharge heater 2. The pressure accompanying the growth of the bubbles first acts on the movable member 6, and as is indicated by a broken line in FIG. 1A, the movable member 6, which is flexibly supported at the fulcrum 6*a*, is displaced so that it is opened widely toward the discharge orifice 5. While the movable member 6 is being displaced, the pressure that is built up due to the generation of the bubbles is transmitted to the discharge orifice 5, toward which the bubbles also grow. As a result, liquid is ejected from the discharge orifice 5.

Specifically, since the movable member 6, the fulcrum 6*a* of which is positioned upstream (near the common liquid chamber 8) in the liquid flowing in the liquid flow path 7 and the free end 6*b* of which is positioned downstream (near the discharge orifice 5), is located in the bubble generation area 10, the pressure from bubbles is directed downward, and directly and efficiently contributes to the ejection of the liquid. Further, the bubbles grow also downstream, and are, therefore, larger downstream than upstream. Since the direction in which the bubbles grow and the direction in which the pressure produced by the bubbles is exerted are controlled by the movable member, the discharge efficiency and the basic discharge characteristic, such as the ejection force or the ejection speed, can be improved.

When the procedure for removing bubbles is initiated, the bubbles are rapidly removed by the geometrical effects accompanying the flexible force of the movable member 6, and the movable member 6 is finally returned to its original position indicated by a solid line in FIG. 1A. At this time, to compensate for the reduced volume of the bubbles in the bubble generation area 10, and to compensate for the volume of the discharged liquid, liquid flows from upstream, i.e., from the common liquid chamber 8, and refills the liquid flow path 7. The refilling of the liquid is efficiently and stably performed.

The liquid discharge head of the invention has circuits and elements for driving or halting the discharge heaters 2. These circuits and elements, in accordance with their functions, are located on the element substrate 1 or on the top plate 3. Since the element substrate 1 and the top plate 3 are made of a silicon material, the circuits and the elements can be easily and excellently produced using a semiconductor wafer processing technique.

An explanation will now be given for the structure of the element substrate 1 that is formed by the semiconductor wafer process technique.

Figure 2:
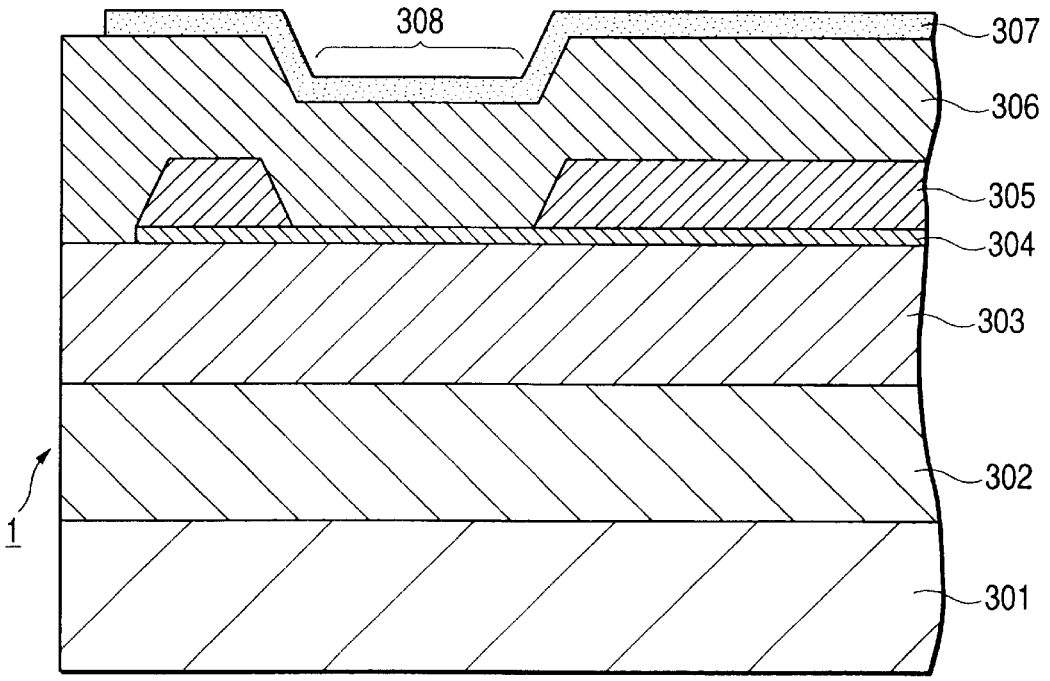
FIG. 2 is a cross-sectional view of an element substrate used for the liquid discharge head in FIGS. 1A and 1B.

FIG. 2 is a cross-sectional view of an element substrate used for the liquid discharge head in FIGS. 1A and 1B. As is shown in FIG. 2, for the element substrate 1 used for the liquid discharge head of the embodiment, a thermal oxide film 302 that serves as a heat accumulation layer and an interlayer film 303 that also serves as a heat accumulation layer are laminated in the named order on a silicon substrate 301. An $SiO_2$ film or an $Si_3N_4$ film is used as the interlayer film 303, a resist layer 304 is formed over part of the surface of the interlayer film 303, and a line 305 is laid over part of the surface of the resist layer 304. An Al or Al alloy, such as Al—Si or Al—Cu, is employed for the line 305, and a protective film 306 made of $SiO_2$ or $Si_3N_4$ is deposited on the line 305, the resist layer 304 and the interlayer film 303. Then an anti-cavitation film 307 is formed on and around the portion of the protective film 306 that corresponds to the resist layer 304, and a portion of the resist layer 304 whereon the line 305 is not laid serves as a heat operated portion 308 on which the heat of the resist layer 304 acts.

For the element substrate 1, these films are laminated on the silicon substrate 301 using a semiconductor fabrication technique, and the heat operated portion 308 is provided on the silicon substrate 301.

Figure 3:
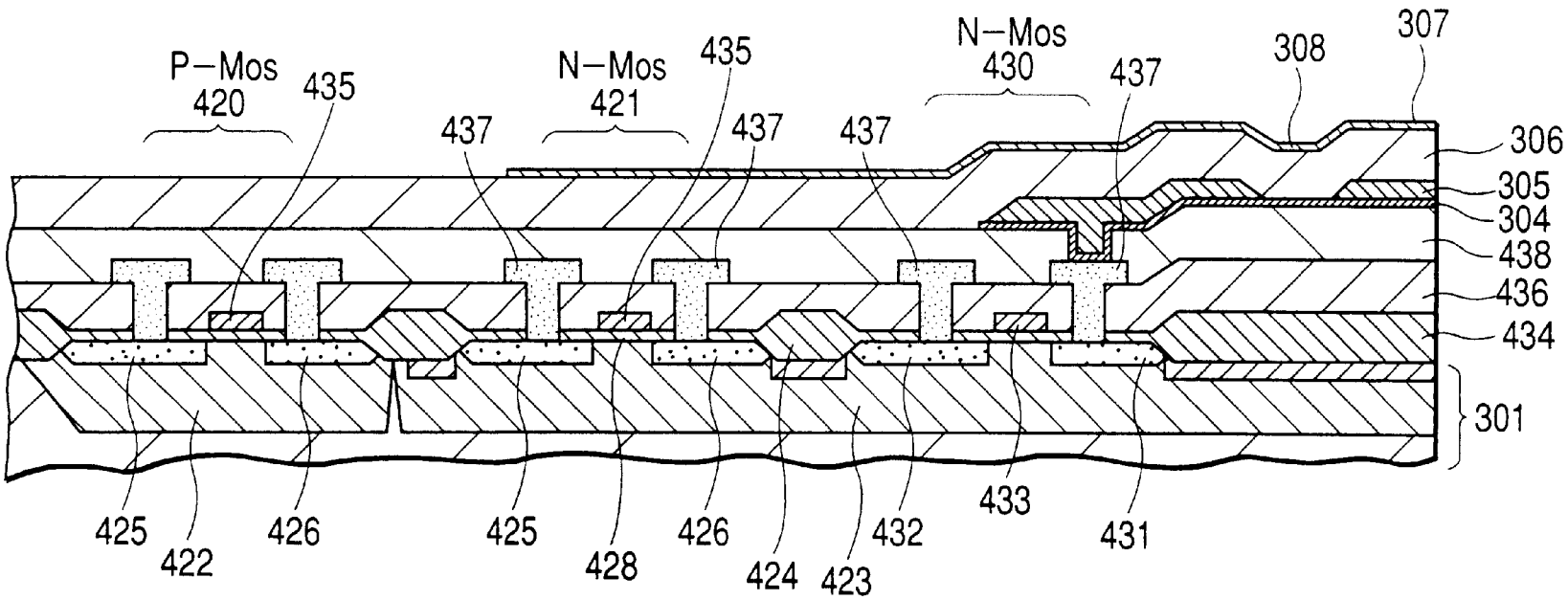
FIG. 3 is a specific vertical cross-sectional view of the element substrate in FIG. 2, cut across its essential elements.

FIG. 3 is a specific vertical cross-sectional view of the element substrate 1 in FIG. 2, taken across the essential elements of the element substrate 1.

As is shown in FIG. 3, an N well region 422 and a P well region 423 are partially deposited on the surface of the silicon substrate 301, which is a P conductive member. A general Mos process is performed to inject and disperse an impurity by ion plantation, so that a P-Mos 420 is deposited on the N well region 422, while an N-Mos 421 is deposited on the P well region 423. The P-Mos 420 includes: a source region 425 and a drain region 426, which are formed by the partial injection of an N or a P impurity into the surface of the N well region 422; and a gate line 435, which is deposited on a gate insulating film 428 several hundreds of Å thick that is deposited on the surface of the N well region 422, except in the source region 425 and the drain region 426. The N-Mos 421 includes: a source region 425 and a drain region 426, which are formed by the partial injection of an N or a P impurity into the surface of the P well region 423; and a gate line 435, which is deposited on a gate insulating film 428 several hundreds of Å thick that is deposited on the surface of the P well region 423, except in the source region 425 and the drain region 426. For the gate line 435, 4000 to 5000 Å of polysilicon is deposited using the CVD method. The P-Mos 420 and the N-Mos 421 constitute C-Mos logic.

An N-Mos transistor 430 for driving an electro-thermal converting element is provided for the portion of the P well region 423 that differs from the N-Mos 421. The N-Mos transistor 430 also includes: a source region 432 and a drain region 431, which are formed by the partial injection of an N or P impurity into the surface of the P well region 423; and a gate line 433, which is deposited on the gate insulating film 428 that is deposited on the surface of the P well region 423, except in the source region 432 and the drain region 431.

In this embodiment, the N-Mos transistor is employed to drive the electro-thermal converting element. However, another type of transistor can be employed, just so long as it can independently drive multiple electro-thermal converting elements, and has the excellent structure described above.

Between the P-Mos 420 and the N-Mos 421 and between the N-Mos 421 and the N-Mos transistor 430, oxide film separation regions 424 of about 5000 to 10000 Å are formed by field oxidization. The individual elements are separated by the oxide film separation regions 424, and the part of the film oxide separation region 424 that corresponds to the heat acting portion 308, when viewed from the surface of the silicon substrate 301, serves as a first heat accumulation layer 434.

On the surfaces of the P-Mos 420, the N-Mos 421, and the N-Mos transistor 430, an interlayer insulating film 436 of about 7000 Å of PSG or BPSG is formed using the CVD method. When the interlayer insulating film 436 has been thermally leveled, wiring is provided by using Al electrodes 437, which serve as a first wiring layer via contact holes that pass through the interlayer insulating film 436 and the gate insulating film 428. An interlayer insulating film 438 of 10000 to 15000 Å of $SiO_2$ is formed, using the plasma CVD method, on the surfaces of the interlayer insulating film 436 and the Al electrodes 437, and a resist layer 304, which is a $TaN_{o.8,hex}$ film of about 1000 Å, is deposited using DC sputtering. The resist layer 304 is electrically connected to the Al electrode 437 near the drain region 431, via a through hole that is formed in the interlayer insulating film 438, and the Al line 305 is laid on the surface of the resist layer 304 and serves as a second wiring layer for the individual electro-thermal converting elements.

The protective film 306, which is deposited on the surfaces of the line 305, the resist layer 304 and the interlayer insulating film 438, consists of 10000 Å of $Si_3N_4$ and is made using the plasma CVD method, and the anti-cavitation film 307, which is deposited on the surface of the protection film 306, consists of about 2500 Å of Ta.

An explanation will now be given for the arrangements of the circuits and the elements on the element substrate 1 and the top plate 3.

Figure 4A:
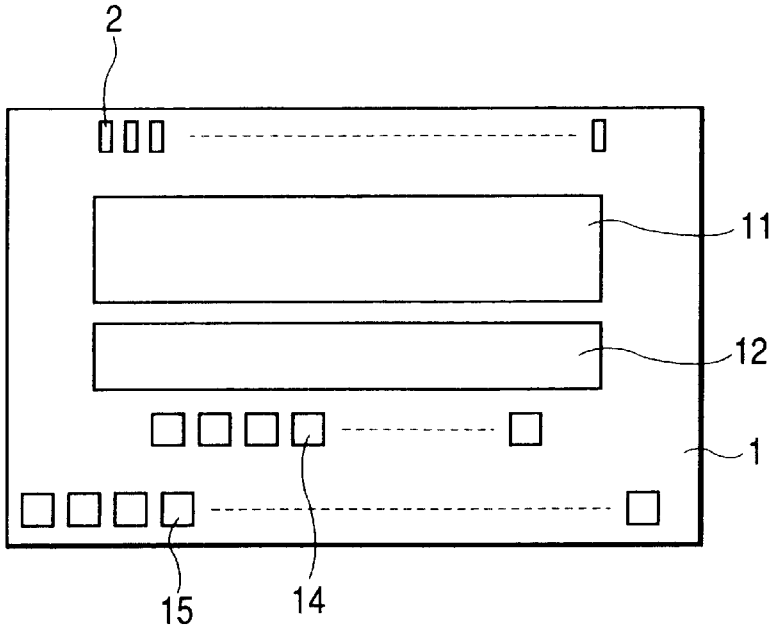
FIGS. 4A and 4B are a plan view of the element substrate and a plan view of a top plate for explaining the circuit structure of the liquid discharge head in FIGS. 1A and 1B.
Figure 4B:
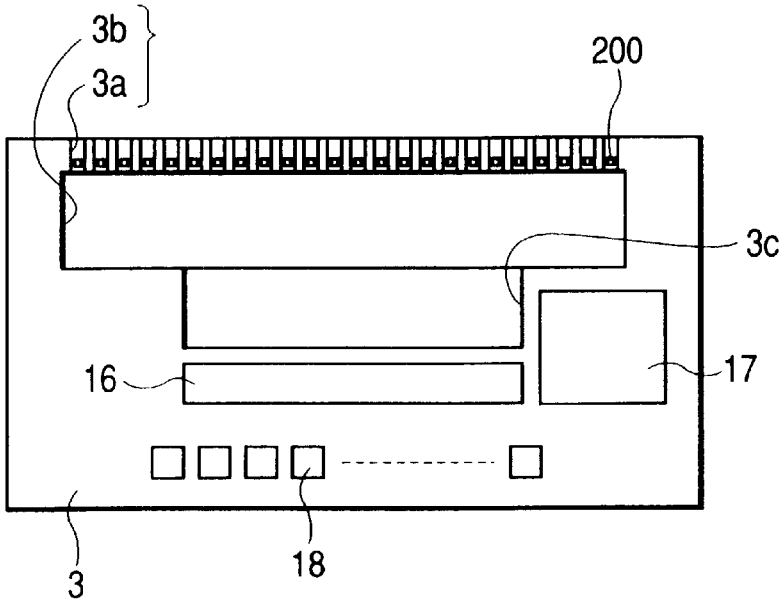

FIGS. 4A and 4B, which are respectively a plan view of the element substrate 1 and a plan view of the top plate 3, are used for explaining the circuit structure of the liquid discharge head in FIGS. 1A and 1B. In FIGS. 4A and 4B, the surfaces that face each other are shown.

As is shown in FIG. 4A, the element substrate 1 includes: a plurality of discharge heaters 2, which are arranged in parallel; a driver 11, which drives the discharge heaters 2 in accordance with image data; and an image data transmitter 12, which outputs the received image data to the driver 11.

The image data transmitter 12 includes: a shift register, for the parallel output to the driver 11 of serially received image data; and a latch circuit, for temporarily storing data that are output by the shift register. The image data transmitter 12 may output image data to the individual discharge heaters 2, or the discharge heaters 2 may be arranged to form a plurality of blocks and the image data transmitter 12 may output the image data to each block. Especially when a plurality of shift registers are provided for one head, and when data received from a recording apparatus are sorted into the shift registers, an increase in the printing speed can be easily coped with.

As is shown in FIG. 4B, the top plate 3 includes: grooves 3*a* and 3*b*, which form the liquid flow paths and the common liquid chamber 8; the flow rate detectors 200, which detect the rate of flow of the liquid in the first liquid flow paths 7; a flow path detector driver 17, which drives the flow rate detectors 200; and a discharge heater controller 16, which to control the drive condition for the discharge heaters 2, the energy generation elements, employs the results output by the temperature detectors 202 of the flow rate detectors 200 that are driven by the flow rate driver 17. A supply port 3*c*, which communicates with the common liquid chamber 8, is opened in the top plate 3 so that liquid can be externally supplied to the common liquid chamber 8.

In addition, connection contact pads 14 and 18 are located at corresponding positions on the faces of the element substrate 1 and the top plate 3, so as to electrically connect the circuits of the element substrate 1 to the circuits of the top plate 3. Further, external compact pads 15, which are provided for the element substrate 1, serve as input terminals for external electrical signals. The element substrate 1 is larger than the top plate 3, and the external contact pads 15 are so located that are exposed and are not covered by the top plate 3 when the element substrate 1 and the top plate 3 are joined together.

The processing performed to mount the circuits on the element substrate 1 and the top plate 3 will now be described.

For the element substrate 1, first, the driver 11 and the circuit that constitutes the image data transmitter 12 are formed on the silicon substrate using the semiconductor wafer process technique. Then, as is described above, the discharge heaters 2 are formed, and finally, the connection contact pads 14 and the external contact pads 15 are mounted on the silicon substrate.

For the top plate 3, first, the discharge heater controller 16, the flow rate detectors 200 and the circuit that constitutes the flow rate detector driver 17 are mounted on the silicon substrate using the semiconductor wafer process technique. Then, as is described above, the grooves 3*a* and 3*b*, which serve as the liquid flow paths and the common liquid chamber, and the supply port 3*c* are formed by film deposition and etching, and finally, the connection contact pads 18 are formed on the substrate.

When the thus obtained element substrate 1 and top plate 3 are aligned and bonded together, the discharge heaters 2 are positioned so that they correspond to the liquid flow paths, and the circuits mounted on the element substrate 1 and the top plate 3 are connected together electrically via the contact pads 14 and 18. These electrical connections may be effected by using a method for mounting metal bumps as the contact pads 14 and 18, or another method may be employed. When the contact pads 14 and 18 are employed for the electrical connection of the element substrate 1 and the top plate 3, the above described circuits can be connected together electrically at the same time as the element substrate 1 is joined together with the top plate 3. After the element substrate 1 and the top plate 3 are joined together, the orifice plate 4 is bonded at the distal end of the liquid flow paths 7, and the fabrication of the liquid discharge head is completed.

While the liquid discharge head in FIGS. 1A and 1B includes the movable members 6, the movable member is also formed on the element substrate 1 by photolithography after the circuits are mounted on the element substrate 1 as is described above. The processing employed when forming the movable member 6 will be described later.

Figure 5:
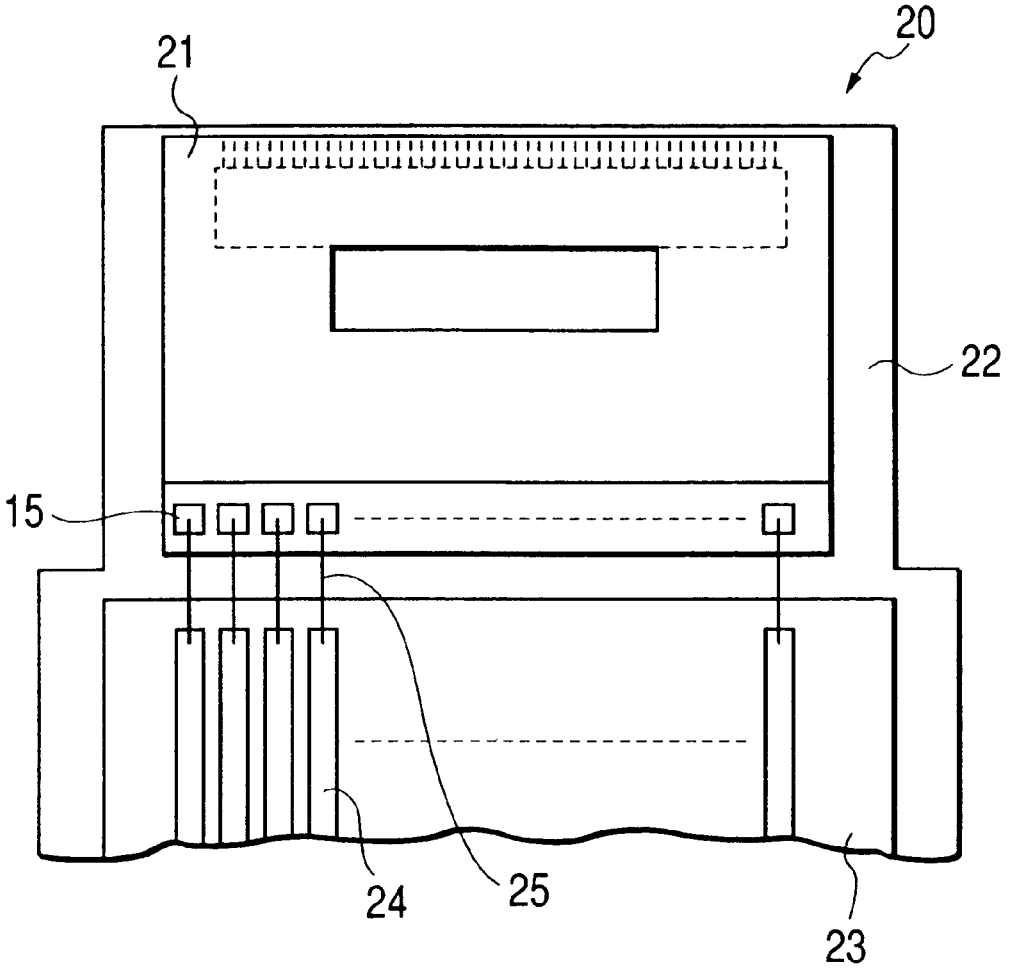
FIG. 5 is a plan view of a liquid discharge head unit on which the liquid discharge head in FIGS. 1A and 1B is mounted.

To mount the thus obtained liquid discharge head on a head cartridge or a liquid discharge apparatus, as is shown in FIG. 5, the liquid discharge head is mounted on a base substrate 22 on which a printed circuit board 23 is placed, so that a liquid discharge head unit 20 is obtained. In FIG. 5, a plurality of line patterns 24, which are to be electrically connected to the head controller of the liquid discharge apparatus, are formed on the printed circuit board 23. These line patterns 24 are electrically connected to the external contact pads 15 via bonding wire 25. Since the external contact pads 15 are provided only for the element substrate 1, the external electrical connection of the liquid discharge head 21 can be performed in the same manner as is the conventional liquid discharge head. In this embodiment, the external contact pads 15 are located on the element substrate 1; however, the contact pads 15 may be provided only for the top plate 3, instead of on the element substrate 1.

As is described above, since the various circuits for driving and halting the discharge heaters 2 are sorted for the element substrate 1 and the top plate 1 while taking into consideration the electrical connection of these two, these circuits are not concentrated on one substrate, so that the liquid discharge head can be compactly made. Further, since the contact pads 14 and 18 are employed for the electrical connection of the circuits of the element substrate 1 to those of the top plate 3, the number of electrical connectors outside of the head is reduced. Therefore, reliability can be improved, the number of required parts can be reduced, and the head can be made more compactly.

The basic arrangement of this embodiment has been explained. The above described circuits will now be described in more detail. It should be noted that the circuit structure is not limited to the structure described below, so long as the same operation can be performed.

An explanation will now be given, while referring to FIGS. 6A and 6B, for the circuit structure for the element substrate 1 and the top plate 3 that controls the energy to be applied to the discharge heaters 2.

Figure 6A:
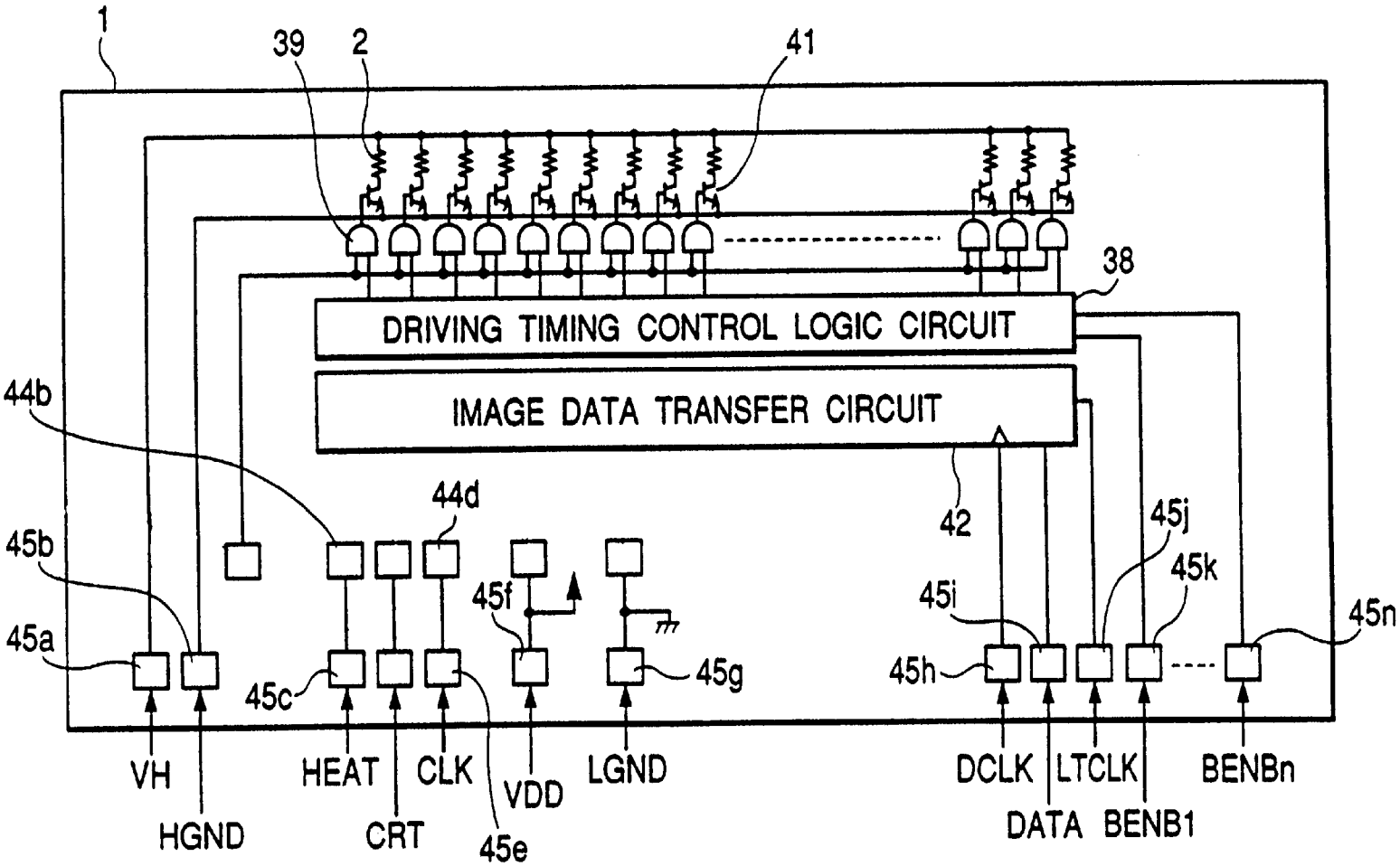
FIGS. 6A and 6B are diagrams showing an example element substrate and an example top plate for, in accordance with a sensor output, controlling the energy applied to a discharge heater.

As is shown in FIG. 6A, the element substrate 1 includes: the discharge heaters 2, which are arranged in one row; power transistors 41, which constitute the driver 11 in FIG. 4A; AND circuits 39, for driving the power transistors 41; a driving timing control logic circuit 38, for controlling the driving timings for the power transistors 41; and an image data transfer circuit 42, which serves as the image data transmitter 12 in FIG. 4A and includes a shift register and a latch circuit.

In order to reduce the power source capacity of the apparatus, the driving timing logic circuit 38 does not render all the discharge heaters 2 active at the same time, but with a delay, separately drives and renders them conductive. Enable signals for driving the driving timing control logic circuit 38 are received from enable signal input terminals 45*k* to 45*n*, which constitute the external contact pads 15 in FIG. 4A.

As the external contact pads 15 provided for the element substrate 1, in addition to the enable signal input terminals 45*k* to 45*n*, there are an input terminal 45*a*, for the driving power for the discharge heaters 2; a ground terminal 45*b*, for the power transistors 41; input terminals 45*c* and 45*e*, for signals that are required for controlling the energy for driving the discharge heaters 2; a drive power source terminal 45*f* and a ground terminal 45*g*, for the logic circuit 38; an input terminal 45*i*, for serial data that are input to the shift register of the image data transfer circuit 42; an input terminal 45*h*, for a serial clock signal that is synchronized with the serial data; and an input terminal 45*j*, for a latch clock signal that is input to the latch circuit.

Figure 6B:
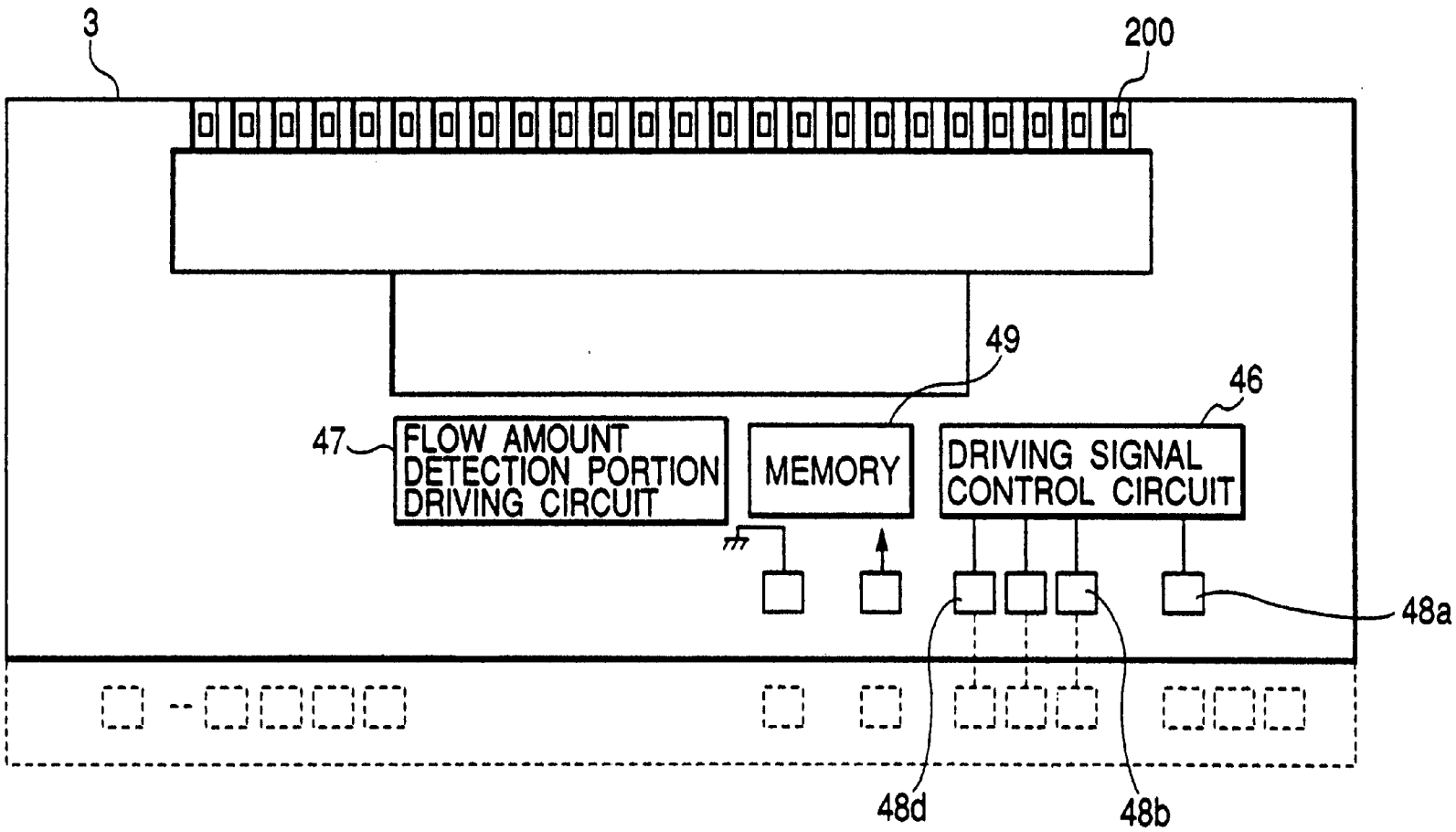

As is shown in FIG. 6B, the top plate 3 includes: a flow rate detector driving circuit 47, which constitutes the flow rate detector driver 17 in FIG. 4B and which drives the flow rate detectors 200; a drive signal control circuit 46, which constitutes the discharge heater controller 16 in FIG. 4B and which monitors the outputs of the flow rate detectors 200 and controls the energy to be applied to the discharge heaters 2 in accordance with the monitoring results; and a memory 49, in which are stored, as head information, temperature data that are detected by the flow rate detector 200 or code values that are sorted by rank, in accordance with the temperature, and the discharged liquid volume characteristic for each discharge heater 2 that is measured in advance (the relationship between the output value of the temperature detector 202, which is cooled by the liquid that flows in the liquid flow path, and the discharged liquid volume at a predetermined pulse). The head information is output to the drive signal control circuit 46.

As the connection contact pads in FIG. 4B, provided for the element substrate 1 and the top plate 3 are: terminals 44*b*, 44*d*, 48*b* and 48*d*, which connect the driving signal control circuit 46 to the input terminals 45*c* and 45*e* and which carry signals that are required for externally controlling the energy used to drive the discharge heaters 2; and a terminal 48*a*, for transmitting the output of the driving signal control circuit 46 to one of the input terminals of the AND circuit 39.

In addition to the discharged liquid volume characteristics, the head information stored in the memory can include the types of liquid to be ejected (especially, the color, when the liquid is ink). This is because, depending on the liquid type, the physical property and the discharge characteristic differ. The head information may be stored as nonvolatile data in the memory 49 after the liquid discharge head has been assembled, or the head information may be transmitted from the apparatus and stored in the memory 49 after the liquid discharge apparatus equipped with the liquid discharge head has been activated.

Further, in the example in FIGS. 6A and 6B, the memory 49 may be mounted on the element substrate 1 instead of on the top plate 3, if more space is available on the element substrate 1.

The ejection of liquid when this arrangement is used will be described later.

An explanation will now be given, while referring to FIGS. 7A and 7B, of the circuit structure provided for the element substrate 1 and the top plate 3 for controlling the temperature of the element substrate.

Figure 7A:
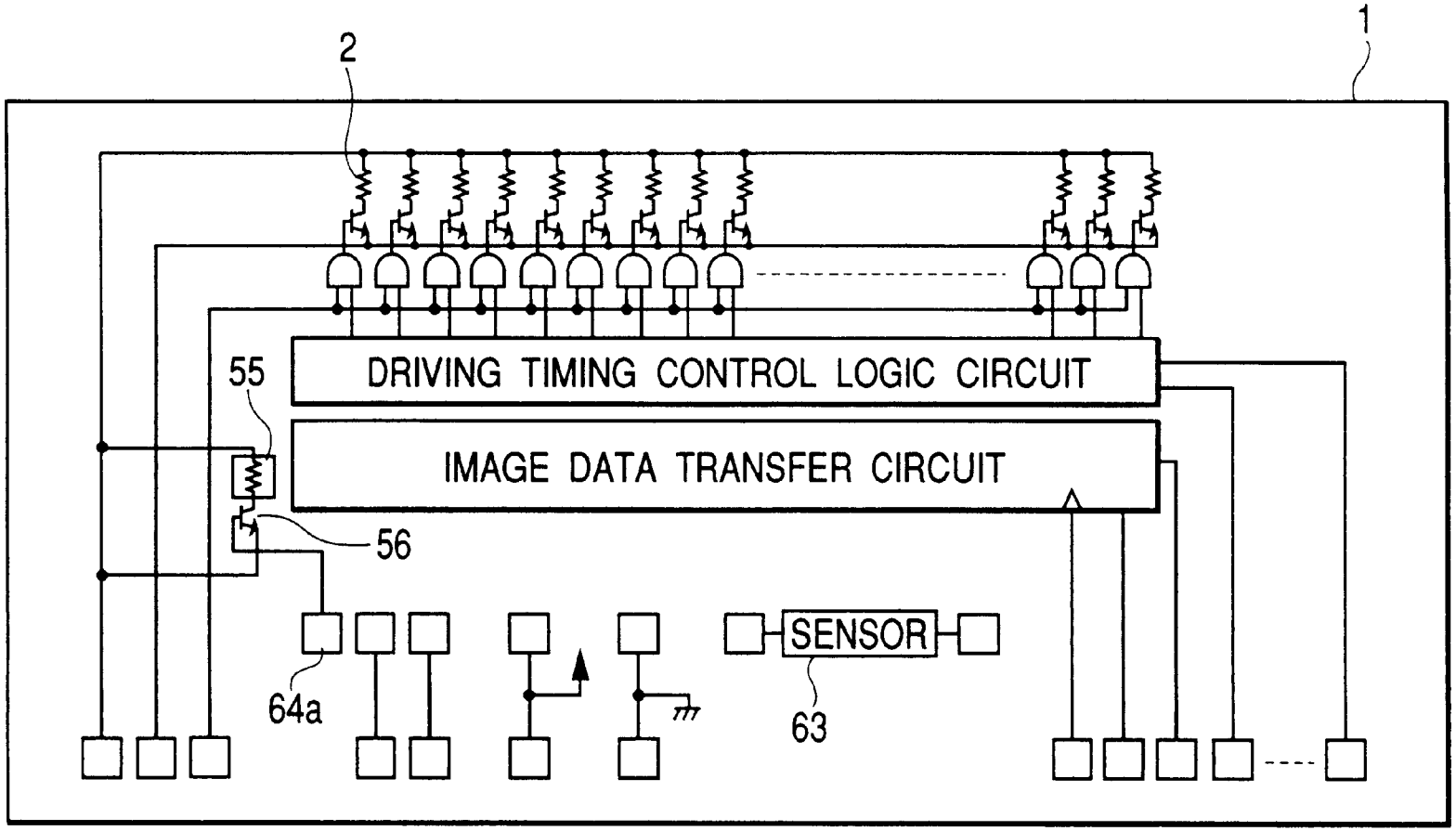
FIGS. 7A and 7B are diagrams showing another example element substrate and another example top plate for, in accordance with a sensor output, controlling the energy applied to a discharge heater.

As is shown in FIG. 7A, in addition to the discharge heaters 2 used for discharging the liquid, an insulating heater 55, which heats the element substrate 1 to adjust the temperature thereof, and a power transistor 56, which serves as the driver for the insulating heater 55, are provided for the element substrate 1 in FIG. 6A. Further, a temperature sensor for measuring the temperature of the element substrate 1 is used as a sensor 63.

Figure 7B:
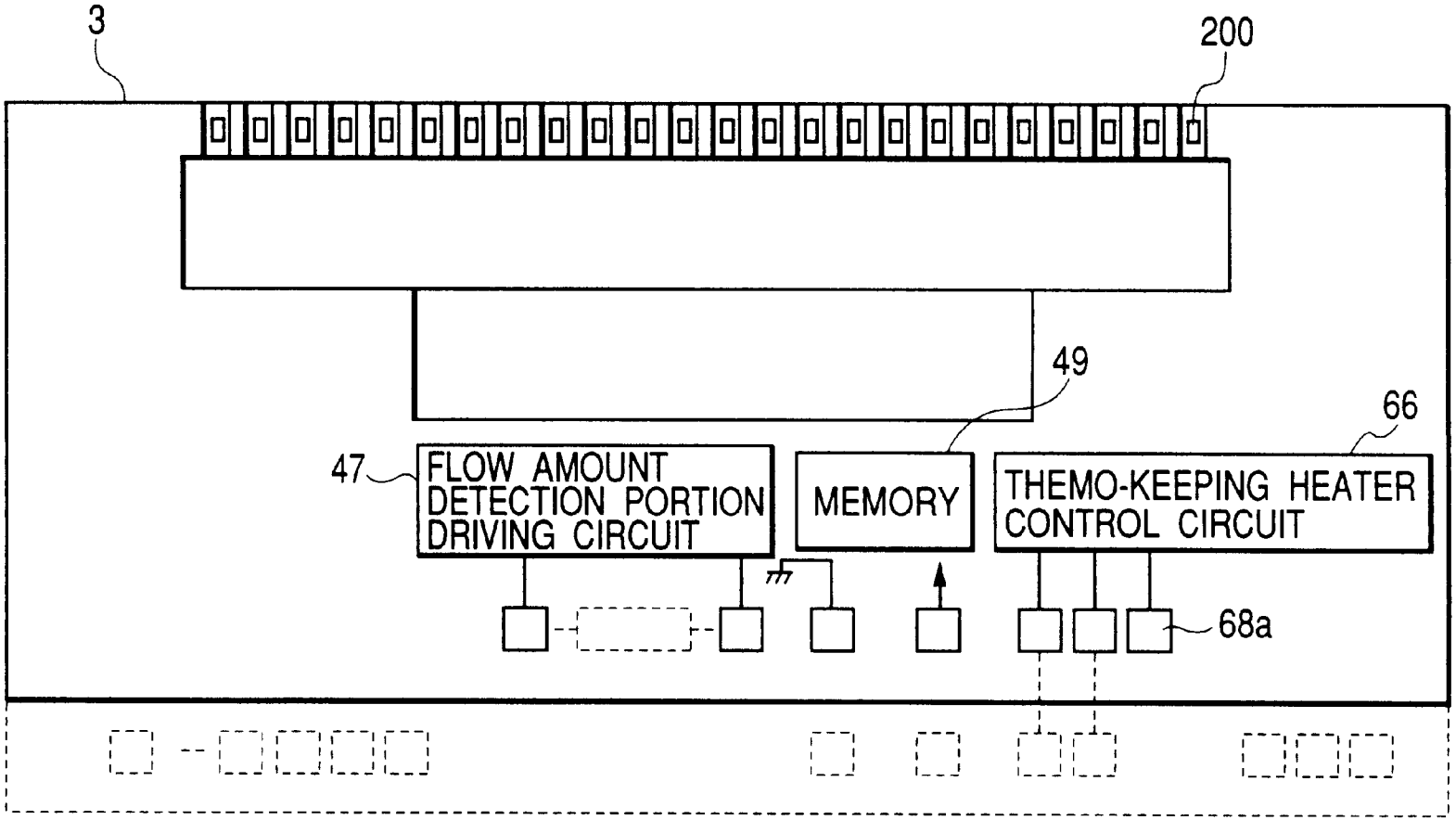

As is shown in FIG. 7B, an insulating heater control circuit 66 is mounted on the top plate 3 in order to drive the insulating heater 55 in accordance with the output of the sensor 63 and the temperature data, which are detected by the flow rate detectors 200, that are stored in the memory 49. The insulating heater control circuit 66 includes a comparator, which compares the output of the sensor 63 with a threshold value, based on the temperature required for the element substrate 1, that is determined in advance. When the output of the sensor 63 is greater than the threshold value, the comparator outputs an insulating heater control signal to drive the insulating heater 55. The temperature required for the element substrate 1 is one that ensures the viscosity of the liquid in the liquid discharge head falls within a stable ejection range.

Terminals 64*a* and 68*a* are provided as contact pads for the element substrate 1 and the top plate 3 in order to transmit, for the insulating heaters, insulating heater control signals from the insulating heater controller 66 to the power transistor 56, which is mounted on the element substrate 1. The other structure is the same as that in FIGS. 6A and 6B.

With the thus obtained arrangement, the insulating heater 55 is driven by the insulating heater control circuit 66, and a predetermined temperature is maintained for the element substrate 1. As a result, the viscosity of the liquid in the liquid discharge head is maintained in a stable ejection range, and preferable ejection of the liquid can be performed.

It should be noted that the output value of the sensor 63 varies due to manufacturing variances. When the temperature is to be adjusted more accurately, to correct for variances, correction values for the output values are stored as head information in the memory 49. In accordance with the correction value stored in the memory 49, the threshold value set for the insulating heater control circuit 66 may be adjusted.

In the embodiment in FIGS. 1A and 1B, the grooves that form the liquid flow paths are formed in the top plate 3, and the member (the orifice plate 4) in which the discharge orifices are formed is also provided separately from the element substrate 1 and the top plate 3. However, the present invention can be applied for a liquid discharge head having another structure.

For example, a wall that is equivalent in thickness to the orifice plate may be left at the end of the top plate, and discharge orifices may be formed therein by using an ion beam or an electron beam, so that the liquid discharge head can be obtained for which an orifice plate is not required. Further, if the flow path side wall is formed on the element substrate instead of forming grooves in the top plate, the positioning accuracy of the liquid flow paths relative to the discharge heaters is improved, and the shape of the top plate can be simplified.

An explanation will now be given for the method whereby photolithography is employed to manufacture an element substrate wherein a movable member is to be provided.

FIGS. 8A to 8E are cross-sectional views, taken along the liquid flow path 7, for explaining an example method for manufacturing the movable member 6 in the liquid discharge head. According to the manufacturing method in FIGS. 8A to 8E, the element substrate 1 on which the movable element 6 is formed is joined with the top plate 3 on which the flow path side wall is formed to obtain the liquid discharge head. Therefore, with this method, the flow path side wall is formed on the top plate 3 before it is joined with the element substrate 1, whereon the movable element 6 is formed.

Figure 8A:
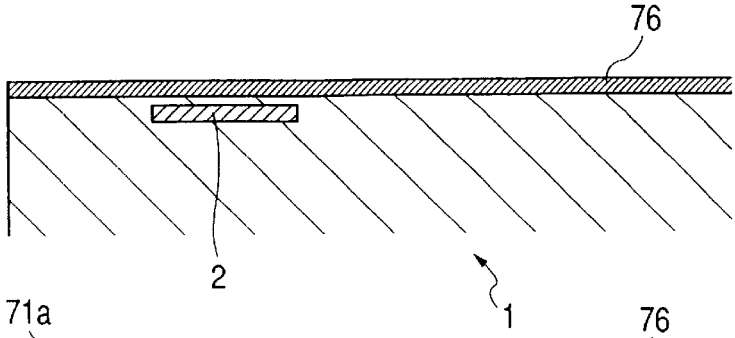
FIGS. 8A, 8B, 8C, 8D and 8E are cross-sectional views for explaining a method for forming a movable member on an element substrate.

First, as is shown in FIG. 8A, using sputtering, a TiW film 76 of about 5000 Å is deposited across the entire surface of the element substrate 1 on the side on which the discharge heaters 2 are located. The TiW film 76 serves as a first protective layer for protecting the connection pads used for the electrical connections with the discharge heaters 2.

Figure 8B:
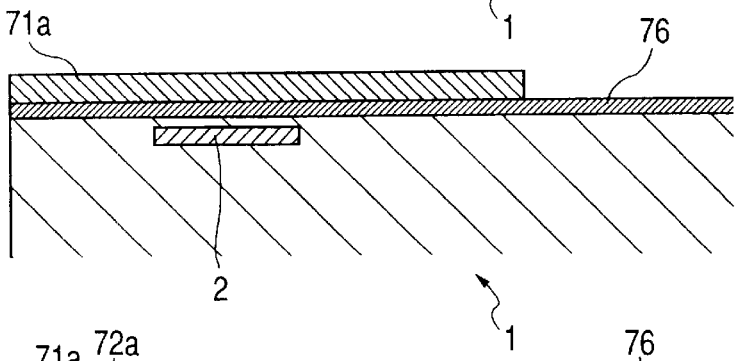

In FIG. 8B, using sputtering, an Al film of about 4 $\mu$m is deposited on the surface of the TiW film 76 to form a gap formation member 71*a*. The gap formation member 71*a* is extended to an area wherein an SiN film 72*a* is etched during the process in FIG. 8D.

The Al film is patterned using the well known photolithography process. Only the portion of the Al film that correspond to the fixed portions of the movable members 6 are removed, and the space formation member 71*a* is then formed in the gap in the TiW film 76. Therefore, the portion of the TiW film 76 that corresponds to the fixed portions of the movable members 6 is exposed. The space formation member 71*a* is the Al film used to form a gap between the element substrate 1 and the movable members 6. The gap formation member 71*a* is formed on the surface of the TiW film 76 that covers the position that corresponds to the bubble generation area 10 between the discharge heater 2 and the movable member 6 and that excludes the portion that corresponds to the fixed portion of the movable members 6. Therefore, according to this manufacturing method, the gap forming member 71*a* is formed on the surface of the TiW film 76 that covers the portion that corresponds to the flow path side wall.

The gap formation member 71*a* functions as an etching stop layer during the process for forming the movable members 6 using dry etching, which will be described later. This is because the TiW film 76, the Ta film that acts as the anti-cavitation film for the element substrate 1, and the SiN film that acts as the protective layer on the resistor would be etched by the etching gas that is used to form the liquid flow path 7. Therefore, to prevent the etching of the layers and films, the gap formation member 71*a* is formed on the element substrate 1, and the surface of the TiW film 76 is not exposed while dry etching is performed for the SiN film to provide the movable members 6. Because of the gap formation member 71*a*, the TiW film 76 and the elements on the element substrate 1 can be prevented from being damaged by the dry etching.

Figure 8C:
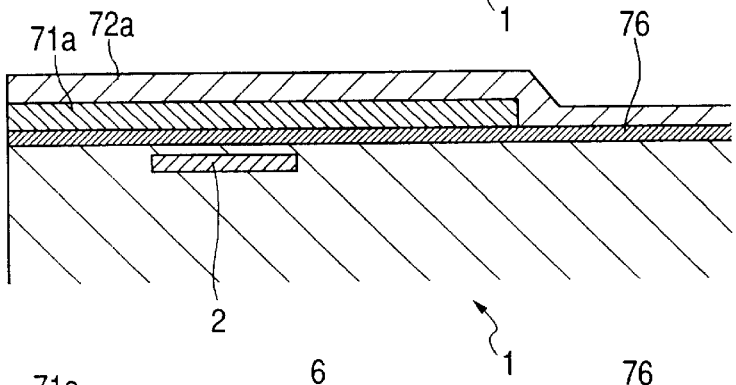

In FIG. 8C, using the plasma CVD method an SiN film 72*a* of about 4.5 $\mu$m, which is the material film used for forming the movable members 6, is deposited across all the surface of the gap formation member 71*a* and all the exposed surface of the TiW film 76, so that the SiN film 72*a* covers the gap formation member 71*a*. In this process, as will be explained later while referring to FIG. 9, an anti-cavitation film made of Ta that is deposited on the element substrate 1 is grounded via the silicon substrate that constitutes the element substrate 1. Thus, the elements, such as the discharge heaters 21 and the latch circuit of the element substrate 1, can be protected from ions and radical charges that are decomposed by plasma discharge in the reaction chamber of a plasma CVD device.

Figure 9:
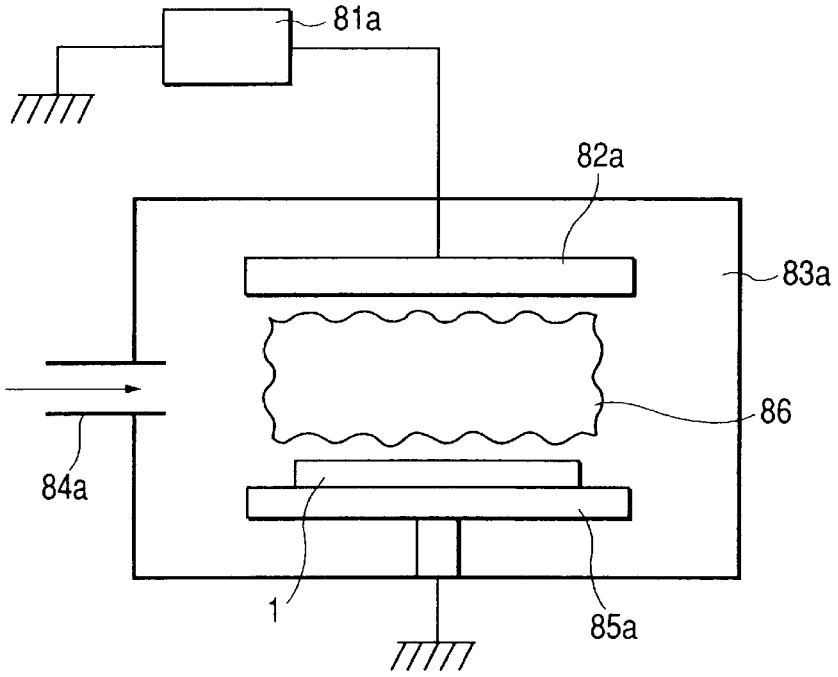
FIG. 9 is a diagram for explaining a method for forming an SiN film on an element substrate using a plasma CVD device.

As is shown in FIG. 9, an RF electrode 82*a* and a stage 85*a* are positioned opposite and at a predetermined distance from each other in a reaction chamber 83*a* of a plasma CVD device in which the SiN film 72*a* is formed. A voltage can be applied to the RF electrode 82*a* by an RF power source 81*a* outside the reaction chamber 83*a*. The element substrate 1 is placed on the stage 85*a*, near the RF electrode 82*a*, with the face of the element substrate 1, the side on which the discharge heaters 2 are positioned, directed toward the RF electrode 82*a*. At this time, the Ta anti-cavitation film, which is formed on the face of the discharge heaters 2 of the element substrate 1, is electrically connected to the silicon substrate that constitutes the element substrate 1, and the gap formation member 71*a* is grounded via the silicon substrate and the stage 85*a*.

In the thus arranged plasma CVD device, while the anti-cavitation film is grounded, a gas is supplied via a supply pipe 84*a* to the reaction chamber 83*a*, and plasma 86 is generated between the element substrate 1 and the RF electrode 82*a*. Since ion or radical charges that are discomposed by the plasma discharge in the reaction chamber 83*a* are deposited on the element substrate 1, the SiN film 72 is formed so that it covers the element substrate 1. At this time, electric charges are generated at the element substrate 1 due to the ion or radical charges. However, since the anti-cavitation film is grounded, as is described above, the elements, such as the discharge heaters 2 and the latch circuit of the element substrate 1 can be protected from damaged by the ion or radical charges.

Figure 8D:
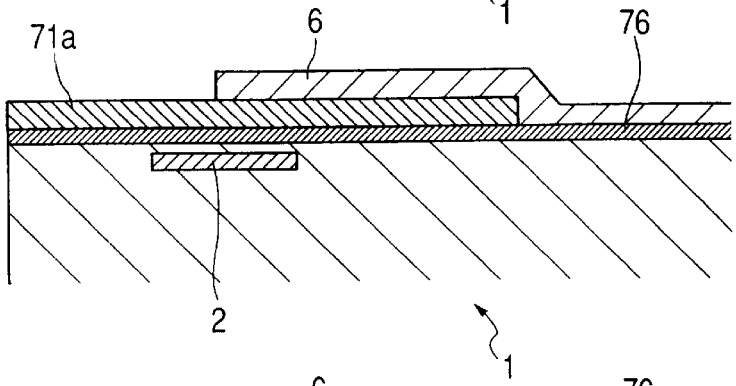

In FIG. 8D, sputtering is used to deposit on the SiN film 72*a* an Al film of about 6100 Å, which is then patterned using the well known photolithography process. As a result, a second protective layer of Al film (not shown) remains on the surface of the SiN film 72*a* that corresponds to the movable members 6. The Al film constituting the second protective layer serves as an etching stop layer, i.e., a mask for the dry etching of the SiN film 72*a* to form the movable members 6.

Following this, with the second protective layer serving as a mask, the SiN film 72*a* is patterned by an etching device employing dielectric coupling plasma, so that the movable members 6 are obtained that constitute the remaining portions of the SiN film 72. In the process for patterning the SiN film 72*a*, the etching device, which employs a gas mixture of $CF_4$ and $O_2$, removes unnecessary portions of the SiN film 72*a* so that the fixed portion of the moveable members 6 is directly secured to the element substrate 1. The material that is used for a portion whereat the fixed portion of the movable member 6 is closely attached to the element substrate 1 contains TiW, which is a material used for the pad protective layer, and Ta, which is a material used for the anti-cavitation film of the element substrate 1.

When the SiN film 72*a* is to be etched using a dry etching device, the gap formation member 71*a* is grounded via the element substrate 1, as will be described later while referring to FIG. 10. Therefore, the ion and radical charges, which are generated by the decomposition of the $CF_4$ gas during the dry etching process, can be prevented from being retained in the gap formation member 71*a*, and elements, such as the discharge heaters 2 and the latch circuit of the element substrate 1, can be protected. Further, since unnecessary portions of the SiN film 72*a* are removed during the etching process, the above described gap formation member 71*a* is formed in the exposed portion, i.e, in the etched region, so that the surface of the TiW film 76 is not exposed, and the element substrate 1 can be satisfactorily protected by the gap formation member 71*a*.

Figure 10:
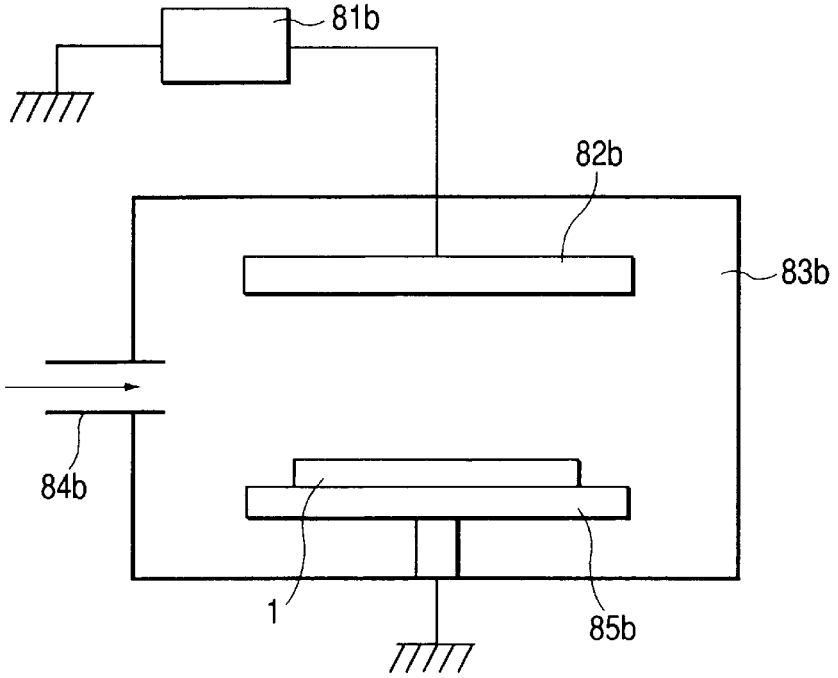
FIG. 10 is a diagram for explaining a method for forming an SiN film on an element substrate using a dry etching device.

As is shown in FIG. 10, an RF electrode 82*b* and a stage 85*b* are positioned opposite and at a predetermined distance from each other in a reaction chamber 83*b* of a dry etching device used for etching the SiN film 72*a*. A voltage is applied to the RF electrode 82*b* by an RF power source 81*b* outside the reaction chamber 83*b*. The element substrate 1 is placed on the stage 85*b*, near the RF electrode 82*b*, and the face of the element substrate 1 on the side of the discharge heaters 2 is directed toward the RF electrode 82*b*. At this time, the gap formation member 71*a* made of the Al film is electrically connected to the anti-cavitation film, made of Ta, on the element substrate 1. Further, as is described above, the anti-cavitation film is electrically connected to the silicon substrate that constitutes the element substrate 1, and the gap formation member 71*a* is grounded via the anti-cavitation film, the silicon substrate and the stage 85*b*.

In the thus arranged dry etching device, while the gap formation member 71*a* is grounded, a gas mixture of $CF_4$ and $O_2$ is supplied through a supply pipe 84*a* to the reaction chamber 83*b*, and the SiN film 72*a* is etched. At this time, electric charges are generated on the element substrate 1 due to the ion and radical charges that are produced by the decomposition of the $CF_4$ gas. However, since as is described above the gap formation member 71*a* is grounded, the elements, such as the discharge heaters 2 and the latch circuit of the element substrate 1, are protected from damage by the ion and radical charges.

In this embodiment, the gas mixture of $CF_4$ and $O_2$ has been supplied to the reaction chamber 83*a*. However, a $CF_4$ gas or a $C_2F_6$ gas that does not contain $O_2$, or a gas mixture of $C_2F_6$ and $O_2$ may be employed.

Figure 8E:
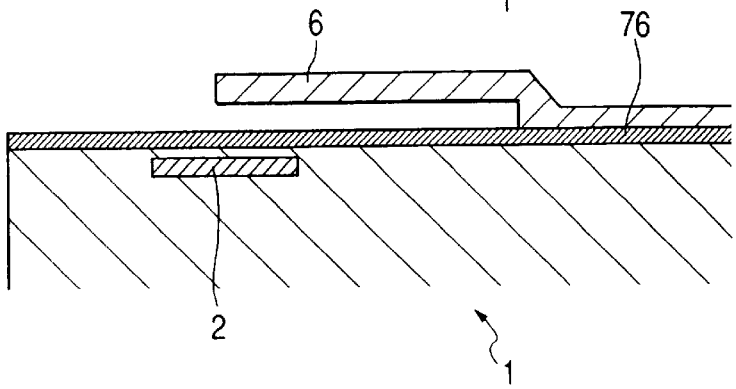

In FIG. 8E, a acid mixture consisting of acetic acid, phosphoric acid and nitric acid is employed to melt and remove the second protective layer, the Al film that is formed on the movable members 6, and the gap formation member 71*a*, which is also an Al film, so that the movable members 6 are is provided above the element substrate 1. Then, hydrogen peroxide is employed to remove the portions of the TiW film 76 on the element substrate 1, that correspond to the bubble generation areas 10 and the pads.

Through this processing, the element substrate 1 on which the movable members 6 are mounted is fabricated. In this embodiment, the liquid discharge head wherein the fixed portions of the movable members 6 are directly fixed to the element substrate 1 has been fabricated. However, this manufacturing method can also be employed for a liquid discharge head wherein a movable member is fixed to an element substrate via a base table. In this case, before the gap formation member 71*a* is formed in FIG. 8B, a base table is formed on the element substrate on the discharge heater side to secure to the element substrate the end opposite the free end. Also in this case, the material for a portion whereat the base table is closely attached to the element substrate contains TiW, which is a material used for the pad protective layer, and Ta, which is a material used for the anti-cavitation film of the element substrate.

In the above embodiment, the flow path side wall has been formed for the top plate 3. However, using photolithography, the flow path side walls 9 may be formed on the element substrate 1 at the same time as the movable members 6 are formed for the element substrate 1.

An explanation will now be given, while referring to FIGS. 11A to 11C and FIGS. 12A to 12C, for an example processing method for forming the movable members 6 and the flow path side walls 9 for the element substrate 1. FIGS. 11A to 11C and 12A to 12C are cross-sectional views, taken along the direction perpendicular to the liquid flow path, of the element substrate wherein the movable members 6 and the flow path side walls 9 are to be formed.

Figure 11A:
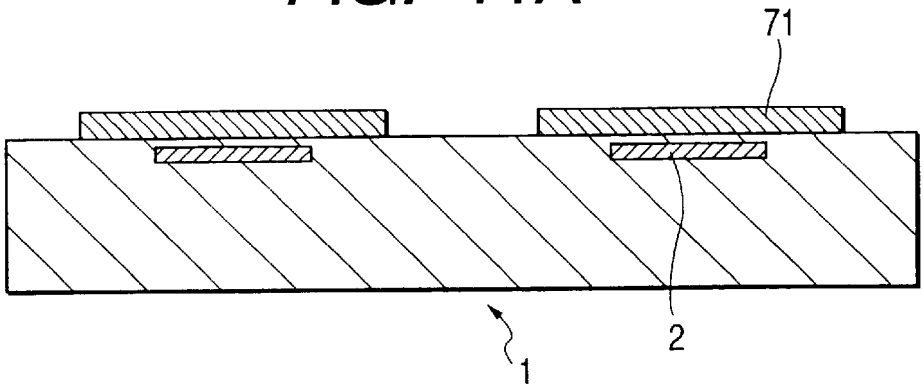
FIGS. 11A, 11B and 11C are cross-sectional views for explaining a method for forming a movable member and flow path side walls on the element substrate.

First, in FIG. 11A, using sputtering, a TiW film (not shown) of about 5000 Å is formed across the entire surface of the element substrate 1 on the side on which the discharge heaters 2 are located. This TiW film is serves as a first protective layer to protect the connection pad portions used for electrical connections with the discharge heaters 2. Then, using sputtering, an Al film of about 4 $\mu$m is formed on the element substrate 1 on the side of the discharge heaters 2 to form the gap formation members 71. The obtained Al film is patterned using the well known photolithography process, and a plurality of gap formation members 71 made of Al are obtained at positions that correspond to the bubble generation area 10 in FIGS. 1A and 1B, between the discharge heater 2 and the movable member 6. The gap formation members 71 are used to define the gaps between the element substrate 1 and the movable member 6. Each gap formation member 71 is extended to an area whereat the SiN film 72, which is the material film for forming the movable member 6, is etched during the process in FIG. 12B, which will be described later.

The gap formation members 71 function as etching stop layers used when the liquid flow paths 7 and the movable member 6 are formed by dry etching, as will be described later. Since the TiW layer that acts as the pad protective layer on the element substrate 1, the Ta film that acts as the anti-cavitation film and the SiN film that acts as the protective layer on the resistor can be etched by the etching gas that is used for forming the liquid flow paths 7, the gap formation members 71 are required to prevent the etching of these layers. Therefore, when the liquid flow paths 7 are to be formed by dry etching, the width of the gap formation member 71 in the direction perpendicular to the liquid flow path 7 are greater than the width of the liquid flow path 7 that will be formed in FIG. 12B, so that the face of the element substrate 1 on the side of the discharge heater 2 and the TiW layer on the element substrate 1 are not exposed.

Further, during the dry etching process, ion and radical charges are generated by the decomposition of the $CF_4$ gas, and these charges may damage the discharge heaters 2 and the other elements of the element substrate 1. However, the gap formation member 71 accepts and stops the ion and radical charges and thus protects the discharge heaters 2 and the other elements of the element substrate 1.

Figure 11B:
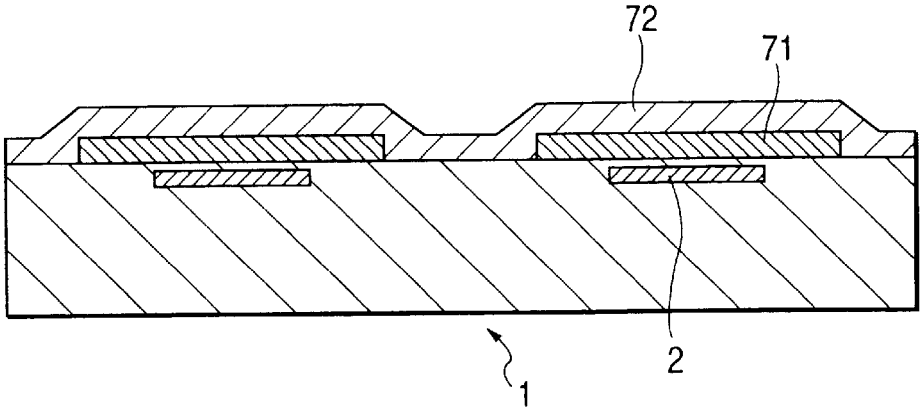

In FIG. 11B, by the plasma CVD method, the SiN film 72 of about 4.5 $\mu$m, which is a material film for forming the movable members 6, is deposited on the surface of the gap formation members 71 and on the element substrate 1 to the side of the gap formation members 71, so that the SiN film 72 covers the gap formation members 71. In this process, as was explained while referring to FIG. 9, the anti-cavitation film of Ta that is deposited on the element substrate 1 is grounded via the silicon substrate that constitutes the element substrate 1. Thus, the discharge heaters 2 and the other elements of the element substrate 1 can be protected from ion and radical charges that are decomposed by the plasma discharge in the reaction chamber of the plasma CVD device.

Figure 11C:
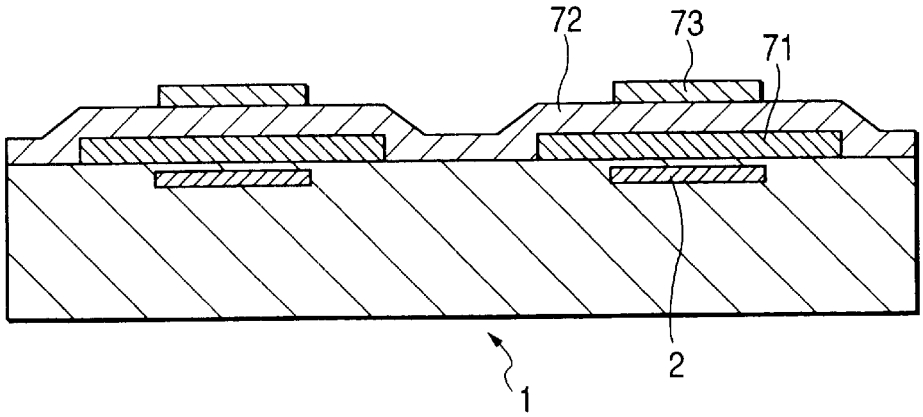

In FIG. 11C, sputtering is used to form on the surface of the SiN film 72 the Al film of about 6100 Å, which is patterned using the well known photolithography process. Then, the Al film 73 is obtained as the second protective layer on the portions that correspond to the movable members 6, i.e., on the movable member formation areas of the SiN film 72. The Al film 73 serves as an etching stop layer used during the dry etching process employed to form the liquid flow paths 7.

Figure 12A:
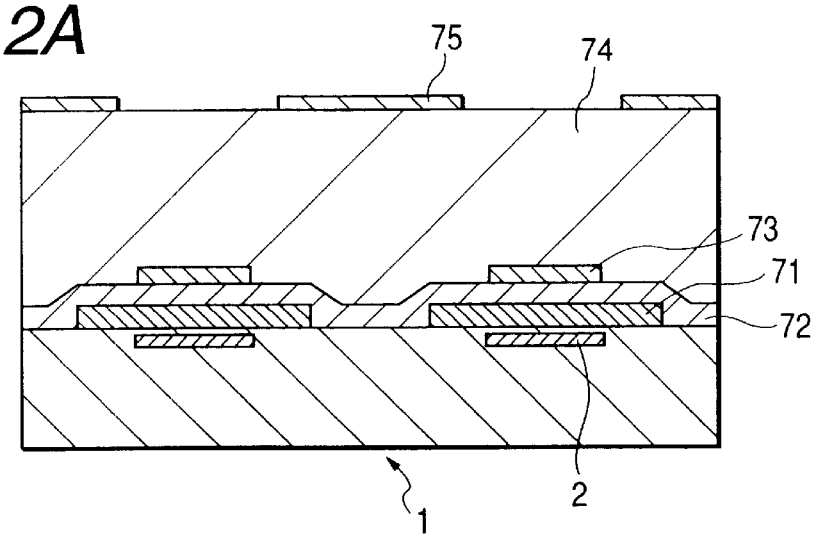
FIGS. 12A, 12B and 12C are cross-sectional views for explaining the method for forming the movable member and the flow path side walls on the element substrate.

Following this, in FIG. 12A, using the microwave CVD method, a SiN film 74 of about 50 $\mu$m is deposited on the surfaces of the SiN film 72 and the Al film 73. The SiN film 74 is used to form the flow path side walls 9. In this example, monosilan ($SiH_4$), nitrogen ($N_2$) and argon (Ar) are the gases employed for the deposition of the SiN film 74 using the microwave CVD method. Besides these gases, disilan ($Si_2H_6$) and ammonia ($NH_3$), or a gas mixture may be employed. Further, when the power of a microwave having a frequency of 2.45 GHz is defined as 1.5 kW, and when monosilan gas, nitrogen gas and argon gas are supplied at respective flow rates of 100 sccm, 100 sccm and 40 sccm, the SiN film 74 is deposited in a high vacuum state under a pressure of 5 mTorr. The SiN film 74 may be deposited by using the microplasma CVD method at another ratio of gas elements, or by using the CVD method while employing the RF power source.

When the CVD method is employed to deposit the SiN film 74, as previously described during the explanation given, while referring to FIG. 9, for the above method used to form the SiN film 72, the anti-cavitation film composed of Ta that is deposited on the discharge heater 2 is grounded via the silicon substrate that constitutes the element substrate 1. Thus, the discharge heaters 2 and the other elements of the element substrate 1 can be protected from the ion and radical charges that are the products of the decomposition of the plasma discharge in the reaction chamber of the CVD device.

After the Al film has been deposited on the entire surface of the SiN film 74, the Al film is patterned using the well known photolithography process, and an Al film 75 is deposited on the SiN film 74, excluding the portions that correspond to the liquid flow paths 7. As was described above, the width of each gap formation member 71 in the direction perpendicular to the liquid flow path 7 is greater than the width of the liquid flow path 7 that will be formed in FIG. 12B, so that the sides of the Al film 75 are located above the sides of the gap formation member 71.

Figure 12B:
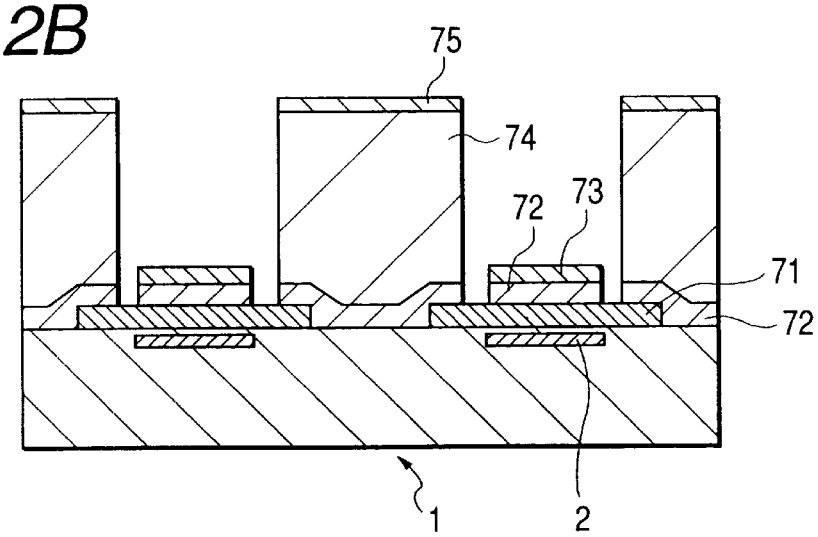

Next, in FIG. 12B, the SiN film 74 and the SiN film 72 are patterned by using an etching device that employs the dielectric coupling plasma, and the flow path side walls 9 and the movable members 6 are formed at the same time. The etching device uses a gas mixture of $CF_4$ and $O_2$ and employs the Al films 73 and 75 and the gap formation member 71 as the etching stop layers, i.e., as masks to etch the SiN films 74 and 72, so that the SiN film 74 has a trench-like structure. During the process for patterning the SiN film 72, unnecessary portions of the SiN film 72 are removed, so that the fixed portion of the movable member 1 is directly secured to the element substrate 1, as is shown in FIGS. 1A and 1B. The material for forming the portion whereat the fixed portion of the movable member 6 is closely attached to the element substrate 1 contains TiW, which is the material used for the pad protective layer, and Ta, which is the material used for the anti-cavitation film of the element substrate 1.

When the SiN films 72 and 74 are to be etched using the dry etching device, as was described while referring to FIG. 10, the gap formation element 71 is grounded via the element substrate 1. Thus, the ion and radical charges, which are generated by the decomposition of the $CF_4$ gas during the dry etching process, are prevented from remaining in the gap formation member 71, and the elements, such as the discharge heaters 2 and the latch circuit of the element substrate 1, can be protected. Further, since the gap formation member 71 is wider than the liquid flow path 7 that is formed in the etching process, when the unnecessary portions of the SiN film 74 are removed, the surface of the element substrate 1 on the discharge heater side is not exposed, and the element substrate 1 is satisfactorily protected by the gap formation member 71.

Figure 12C:
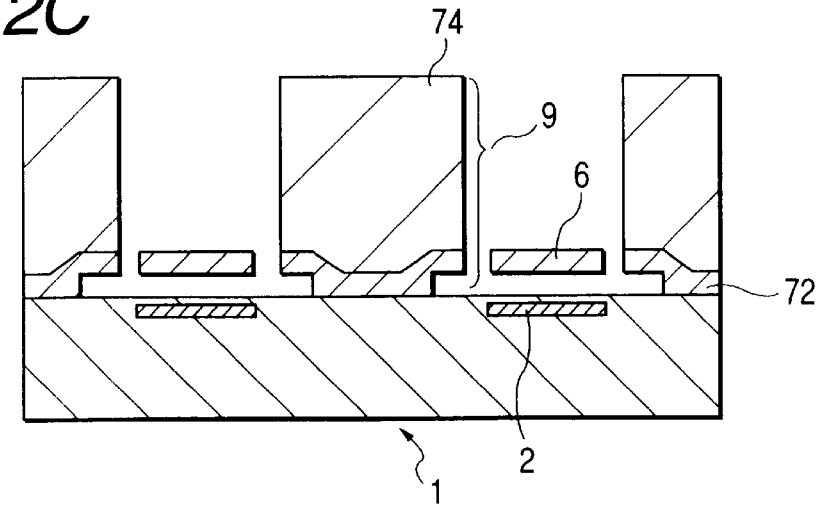

In FIG. 12C, a acid mixture of acetic acid, phosphoric acid and nitric acid is employed to thermally etch the Al films 73 and 75, and the Al films 73 and 75 and the gap formation members 71 that are made of Al are melted and removed. As a result, the movable members 6 and the flow path side walls 9 are obtained above or on the element substrate 1. The material for forming the portion whereat the flow path side walls 9 are closely attached to the element substrate 1 also contains TiW, which is the material used for the pad protective layer, and Ta, which is the material used for the anti-cavitation film of the element substrate 1.

The arrangement of the liquid discharge head and the manufacturing method therefor for the first embodiment have been explained. The control for the volume of a liquid discharged by the head will now be described while referring to the timing chart in FIG. 13, used to explain the detection of the flow rate of the liquid.

Figure 13:
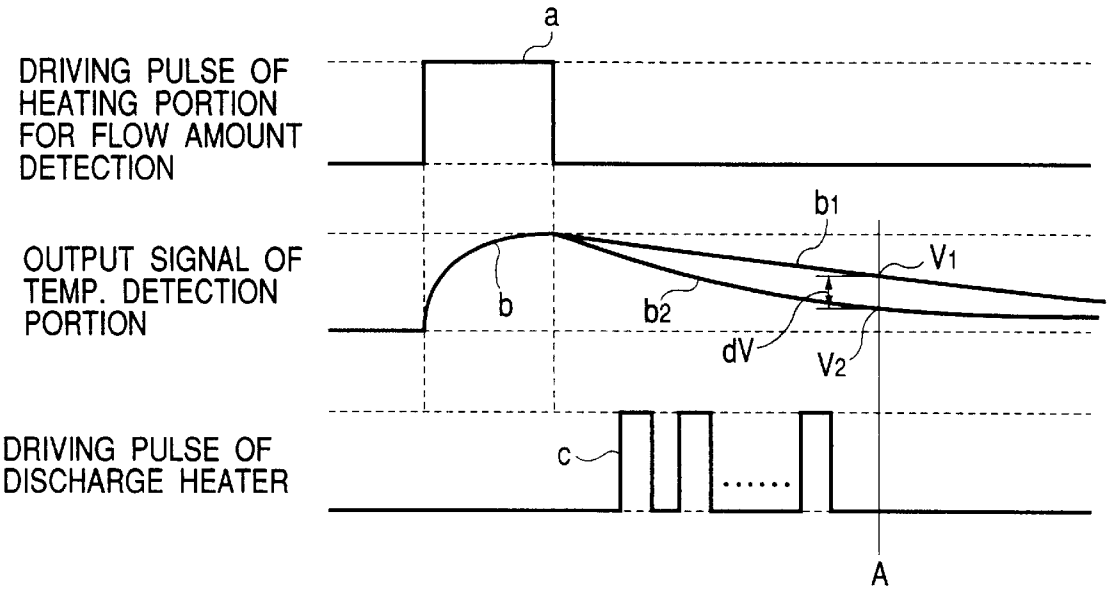
FIG. 13 is a timing chart for explaining the detection of the flow rate of a liquid.

In FIG. 13, a top line "a" represents a pulse voltage to be applied to the heat generator for flow rate detection, a middle line "b" represents a voltage value output by the temperature detector 202, and a bottom line "c" represents a pulse voltage to be applied for driving the discharge heater 2.

First, the measurement of the volume of a discharged liquid will be explained.

A drive pulse is output (line a) for flow rate detection by the flow rate detector driver 47 to the heater generator 201, which then generates heat. The heat generated by the heat generator 201 is transmitted to the temperature detector 202, and the temperature of the temperature detector 202 is increased with a first delay (line b). Then, the temperature detector 202 outputs a detected voltage to the memory 49. The diving signal control circuit 46 transmits a drive pulse to the discharge heater 2 at the trailing edge of the drive pulse that is transmitted by the driving circuit 47 to the heat generator 201, and when the detected voltage output by the temperature detector 202 is high, i.e., when the temperature of the temperature detector 202 is high because it has been heated by the heat generator 201 (line c). Thus, the discharge heater 2 generates heat to produce bubbles, and the movable member 6 is displaced, so that the liquid is ejected from the discharge orifice 5. When the liquid has been discharged and bubbles have been removed, the movable member 6 is returned to the original position. At this time, to compensate for the volume of the discharged liquid, liquid flows in from upstream, i.e., from the common liquid chamber 8, and refills the liquid flow path 7. Since the liquid is supplied along the first liquid flow path 7*a*, the heat of the temperature detector 202 is removed by the liquid flowing near the temperature detection face 203 of the temperature detector 202. Accordingly, the temperature of the temperature detector 202 is reduced, and the detected voltage output by the detector 202 is lowered. The transmission of heat between the temperature detection face 203 and the liquid is affected by the size of the detection face 203, the current physical value of the liquid, and the flow velocity of the liquid. Further, the flow rate of the liquid is determined in accordance with the relationship between the cross-sectional size of the first liquid flow path 7*a* and the flow velocity of the liquid. In accordance with the relationship, the drop in the voltage output by the temperature detector 202 is calculated as the flow rate of the liquid that is refilling the first liquid flow path 7*a*. Furthermore, since the volume of the liquid required to refill the first liquid flow path 7*a* is equal to the volume of the liquid that was discharged, the volume of the discharged liquid can be obtained.

It should be noted that the drop in the voltage that is output by the temperature detector 202 is actually detected at a timing A in FIG. 13, i.e., after a plurality of pulses are transmitted to the discharge heater 2. The reason for this is as follows: Since the duration of one pulse transmitted to the discharge heater is on the order of several to several tens of $\mu$sec, a single pulse is so short that the liquid can not cool the temperature detector 202. Further, the noise element, which is caused by a back wave that occurs when the movable member is displaced, as is indicated by the broken line in FIG. 1A, and that is transmitted upstream, is greater in the liquid that flows upstream than in the liquid that flows downstream. Therefore, the effect due to the noise element should be reduced. Specifically, when a plurality of pulses are transmitted to the discharge heater 2, the time for cooling the temperature detector 202 as the liquid is flowing is extended, so that the drop in the voltage output by the temperature detector 202 is increased. Further, since apparently the liquid constantly flows from upstream to downstream, the noise element due to the back wave can be reduced and a measurement error is smaller.

The volume of the liquid discharged is measured for each liquid flow path. Since the flow rate detectors 200 provided for the individual flow paths are formed at the same time by the semiconductor process, there is substantially no variance in the characteristics of the flow rate detectors 200, and accordingly, there is substantially with no variance in the measurement results obtained from the flow paths.

An explanation will now be given for the control for the volume of the discharged liquid based on the measurement results for the discharged volume.

First, the control of the volume of discharged liquid will be explained when, depending on the liquid flow paths, the obtained volume is varied.

A difference in the flow rates of the liquid, i.e., a difference in the volume of the liquid discharged, is measured as follows.

Figure 14:
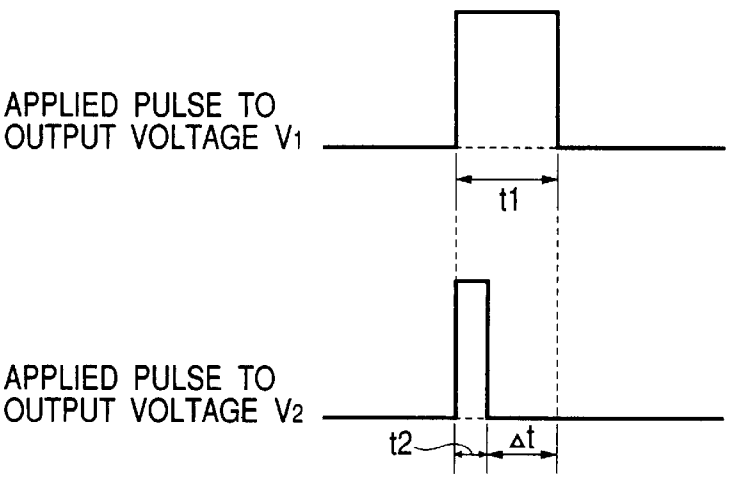
FIG. 14 is a diagram showing a pulse to be transmitted by a discharge heater controller to a discharge heater.

For example, as is shown in FIG. 13, if the flow rate of the liquid in the first liquid flow path is low, the quantity of the heat removed from the temperature detector 202 is small, and the output voltage of the temperature detector 202 is represented as a curve b1. When the flow rate of the liquid is high, the quantity of the heat removed from the temperature detector 203 is large, and the output voltage of the temperature detector 202 is represented as a curve b2, below the curve b1. Therefore, the output voltage of the temperature detector 202 at the measurement timing A is a voltage value V1 when the flow rate of the liquid is low, or a voltage value V2 when the flow rate is high. As a result, a voltage difference dV is obtained. These output voltages are stored in the memory 49, and based on the stored data, the driving signal control circuit 46 transmits a signal to the AND circuit 39 to instruct it to output a pulse shown in FIG. 14 to the discharge heater 2. That is, the driving signal control circuit 46 transmits a drive pulse t1 to the discharge heater 2 that is provided along the liquid flow path 7 for which the voltage value V1, which represents a low flow rate, is output. The width of the pulse t1 is greater by Δt than the drive pulse t2 that is transmitted to the discharge heater 2 that is provided along the liquid flow path 7 for which the voltage V2, which represents a high flow rate, is output. As a result, the variances in the discharge quantities among the liquid flow paths can be removed.

An explanation will now be given for the control of the absolute volume of discharged liquid for each liquid flow path, instead of the control of the relative differences in the discharge quantities detected for the liquid flow paths.

The absolute volume of the liquid discharged from each liquid flow path is measured as follows.

A discharged liquid volume characteristic, which is the relationship between the volume of a discharged liquid and the output voltage value of the temperature detector 202, is stored in advance in the memory 49. When the stored voltage value is compared with the voltage value V1 or V2 that is measured at the timing A in FIG. 13, the discharge volume at the voltage V1 or V2 can be obtained.

When there is a difference between the voltage value V for a desired volume of discharge liquid and the voltage V1 or V2, as is described above the width of the drive pulse to be transmitted to the discharge heater 2 is changed to control the volume of the liquid discharged. As a result, the difference from a desired volume is removed.

When the overall volume of the liquid discharged from the liquid discharge head is small, the insulating heater control circuit 66 may output a signal to drive the insulating heater 55, and the viscosity of the liquid may be reduced to increase the volume of the liquid discharged.

Further, the volume of the liquid discharged may be controlled both by changing the width of the driving pulse that is to be transmitted to the discharge heater 2, and by driving the insulating heater 55 to reduce the viscosity of the liquid.

Figure 15:
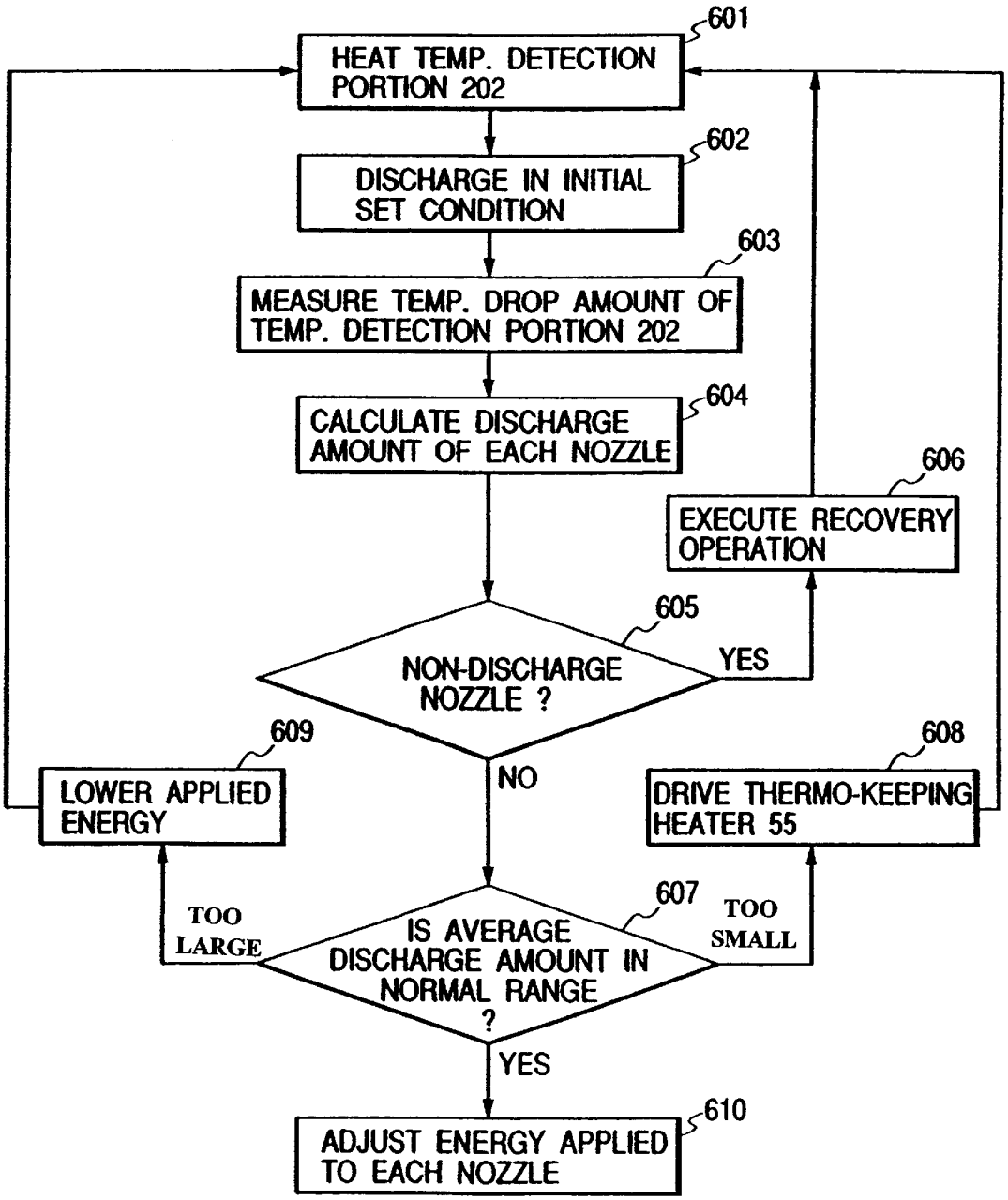
FIG. 15 is a flowchart for explaining the overall processing for controlling the volume of discharged liquid.

The overall processing for the control of the volume of the discharged liquid will now be described while referring to the flowchart in FIG. 15. A "nozzle" used in this processing includes: a discharge heater 2; a discharge orifice 5 that is formed in the orifice plate 4; and a liquid flow path 7 that is defined by bonding the top plate 3 and the element substrate 1. All of these components are required to eject a liquid.

First, the temperature detector 202 is heated by the heat generator 201 for flow rate detection, and the temperature of the temperature detector 202 is increased (step 601). Then, the liquid is ejected a plurality of times under the initially set conditions (step 602). The reduction in the temperature of the temperature detector 202, which is the result of the resupply of liquid to the first liquid flow path 7*a*, is measured (step 603). The driving signal control circuit 46 employs the obtained reduction in the temperature to calculate the discharge volume for each nozzle (step 604). The driving signal control circuit 46 determines whether there is a nozzle from which liquid is not being ejected (step 605). If there is an unused nozzle, the recovery process is performed for that nozzle (step 606), and the process at steps 601 to 605 is repeated. When at step 605 it is ascertained that there is no unused nozzle, a check is performed to determine whether the average volume of discharged liquid falls within a normal range (step 607). If the average volume is small, the insulating heater 55 is driven to reduce the viscosity of the liquid, so that the average volume of the discharged liquid is increased (step 608). The processes at step 601 to 607 are then repeated. When it is ascertained that the average volume of discharged liquid is large, the energy to be applied to the discharge heater 2 is reduced to lower the volume of the discharged liquid (step 609). Then, the processes at steps 601 to 607 are repeated. When in this manner the average volume of the liquid discharged through each nozzle of the liquid discharge head is corrected so that it falls within the normal range, the amount of liquid discharged through each nozzle is further adjusted to a desired volume (step 610).

In this manner, the volume of the liquid discharged through each nozzle can be controlled.

In this embodiment, the flow rate detectors 200 are provided for the top plate 3. However, the detectors 200 may be provided for the movable members 6 or for the element substrate 1. When the flow rate detector 200 is to be formed on a removable member 6 made of a silicon material, the semiconductor process techniques that were used for the element substrate 1 and the top plate 3 are employed.

Figure 16A:
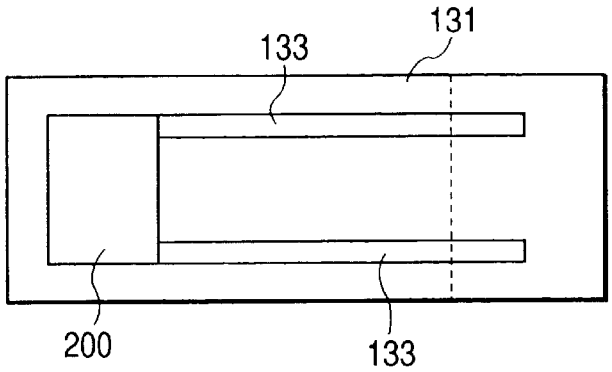
FIGS. 16A and 16B are diagrams showing the arrangement wherein a flow rate detector is provided in a three-dimensional assembly.
Figure 16B:
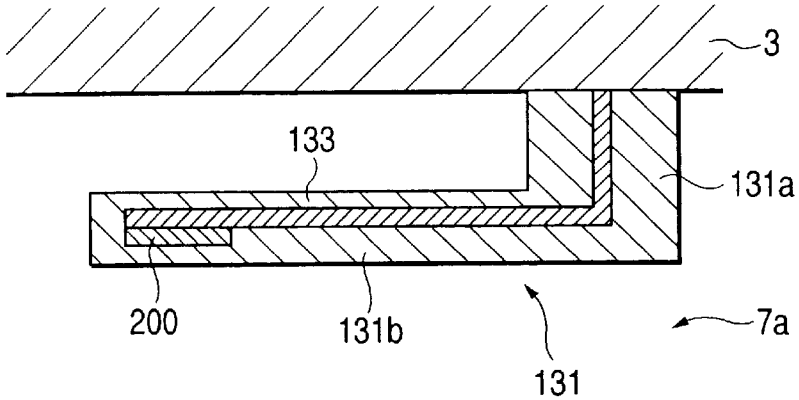

The flow rate detector 200 may be provided inside a three-dimensional assembly 131 in FIGS. 16A and 16B. The three-dimensional assembly 131 includes a strut 131*a* that projects downward from the top plate 3, and a beam 131*b* that extends outward from the strut 131*a*. The flow rate detector 200, which is electrically connected to the flow rate detector driving circuit 47 by a line 133, is located at the distal end of the beam 131*b*. The beam 131*b* may be extended in any direction so long as it does not interrupt the flow of the liquid. The three-dimensional assembly 131 in which the flow rate detector 200 is provided may also be formed by the semiconductor process technique. With this arrangement, both detection faces of the flow rate detector 200 are exposed to the liquid that flows in the first liquid flow path 7*a*, and since the detector 200 is located at a distance from the wall, the flow rate can be measured at a region that is not affected by the liquid flow boundary layer near the wall. The three-dimensional assembly 131 is not limited to the shape shown in FIGS. 16A and 16B, and may be constructed by using only the strut 131*a*, eliminating the beam 131*b*, with the flow rate detector 200 provided in the strut 131*a*.

In addition, in this embodiment, one flow rate detector 200 is provided for each liquid flow path 7; however, more than one detector 200 may be provided. When multiple flow rate detectors 200 are provided for each liquid flow path 7, they may be positioned on the top plate 3, on the element substrate 1, on the movable member 6 or on the three-dimensional assembly 131, or a combination of locations, the top plate 3, the movable member 6, the element substrate 1 and the three-dimensional assembly 131, may be used.

If the output value from the flow rate detector 200 does not seem to represent the ejection of the liquid, even though the discharge heater 2 is driven, e.g., if the temperature detector 202 is cooled not by the resupply of liquid from upstream to downstream but only by the stirring the liquid due to the back wave generated by the displacement of the movable member 6, the flow rate detector driver 47 determines that the liquid is not being ejected due to clogging of the discharge orifice 5. The flow rate detector driver 47 therefore outputs a signal to a recovery controller (not shown) to perform the suction/recovery operation that will be described later. With this operation, the ejection characteristic of the liquid discharge head may be recovered.

As is described above, according to the first embodiment, the volume of the discharged liquid is obtained by measuring the flow rate of the liquid in each liquid flow path, and as the volume of the discharged liquid is controlled, it is possible to correct variances in the volumes of the liquid discharged, from the individual liquid flow paths, that is due to an increase of the viscosity of the liquid as the time elapses.

Second Embodiment

A liquid discharge head according to a second embodiment of the present invention will now be described.

Figure 17:
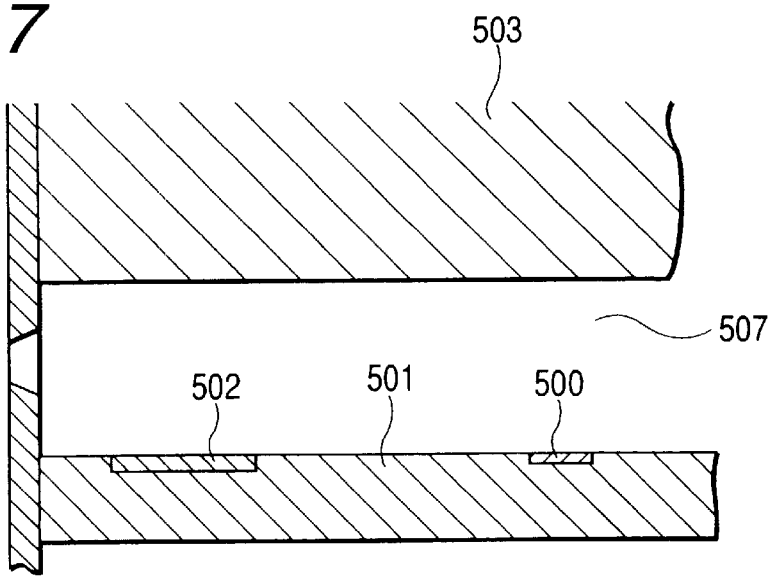
FIG. 17 is a cross-sectional view, taken along a liquid flow path, for explaining the structure of a liquid discharge head according to a second embodiment of the present invention.

FIG. 17 is a cross-sectional view of the liquid discharge head of this embodiment along a liquid flow path.

The liquid discharge head of this embodiment is substantially the same as that for the first embodiment, except that a removable member 6 is not provided and a flow rate detector 500 is provided for an element substrate 501. Therefore, no detailed explanation for this liquid discharge head will be given.

The flow rate detector 500 is located in the element substrate 501 at a distance whereat the detector 500 is not thermally affected by a discharge heater 502.

Also in this embodiment, not only one flow rate detector 500, but rather multiple detectors 500 may be provided in each liquid flow path 507.

Further, in this embodiment, the flow rate detector 500 is provided for the element substrate 501; however, the detector 500 may be provided for the top plate 502, or the three-dimensional assembly described for the first embodiment may be projected into the liquid flow path 507 and the flow rate detector 500 provided for the three-dimensional assembly. The three-dimensional assembly may be provided for the element substrate 500 or for the top plate 503.

In addition, instead of one flow rate detector 500, multiple flow rate detectors 500 may be provided in the liquid flow path 507. In this case, a plurality of flow rate detectors 500 may be formed in the element substrate 500, the top plate 503 and the three-dimensional assembly, in the element substrate 501 and the top plate 503, in the element substrate 501 and the three-dimensional assembly, in the top plate 503 and the three-dimensional assembly, or in the element substrate 501, the top plate 503 and the three-dimensional assembly.

As is described above, according to the second embodiment, the volume of the discharged liquid is obtained by measuring the flow rate of the liquid in each liquid flow path, and since the volume of the discharged liquid is controlled, it is possible to correct variances, in the volumes of the liquid discharged from individual liquid flow paths, that are due to an increase in the viscosity of the liquid as the time elapses.

An electro-thermal converting element is employed as the energy generating element in these embodiments; however, the present invention is not limited to this application, and can be applied for an electro-thermal converting element, such as a piezoelectric element, that is used as an energy generating element.

A liquid discharge apparatus on which the above described liquid discharge head is mounted will now be described while referring to FIG. 18.

Figure 18:
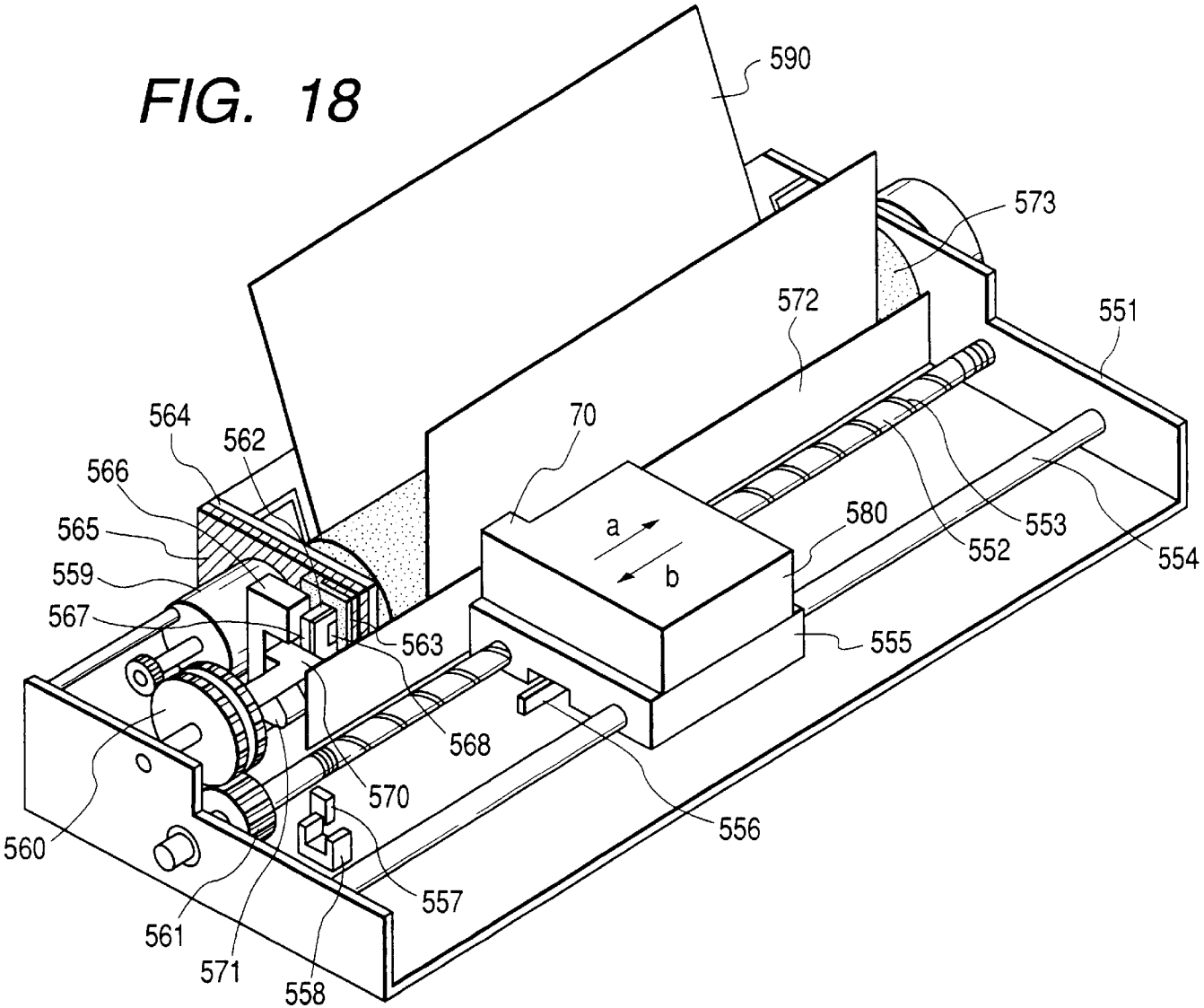
FIG. 18 is a schematic perspective view of a liquid discharge apparatus according to the present invention.
Figure 19:
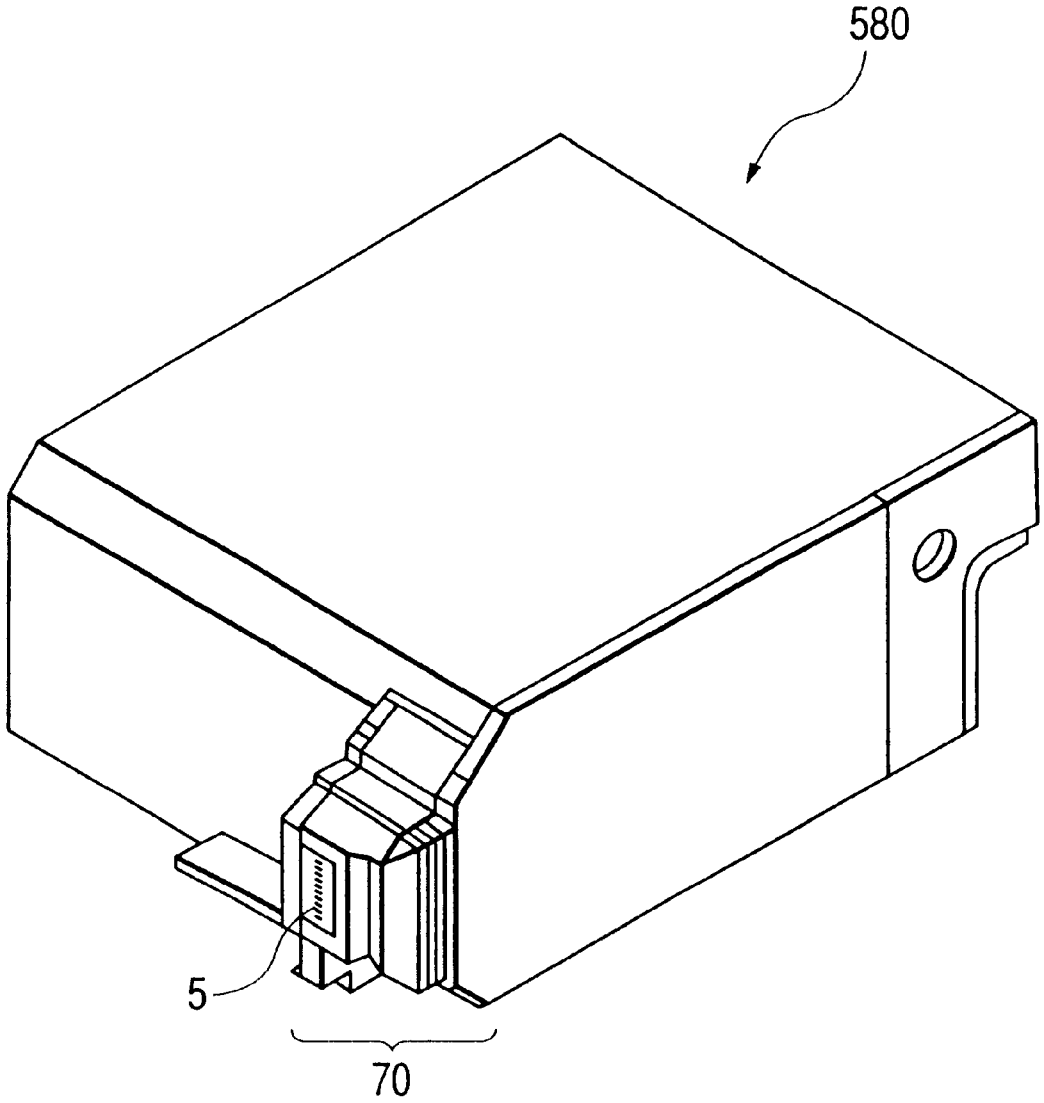
FIG. 19 is a perspective view of the external appearance of an example liquid discharge head cartridge according to the present invention.

FIG. 18 is a schematic perspective view of an example liquid discharge apparatus according to the present invention. FIG. 19 is a perspective view of the external appearance of a liquid discharge head cartridge 580 used for the liquid discharge apparatus in FIG. 18. In FIG. 18, a lead screw 552 in which a spiral groove 553 is cut is rotatably fitted to a main frame 551. The lead screw 552 is rotated via drive force transmission gears 560 and 561, interacting with the forward and backward rotation of a drive motor 559. Further, a guide rail 554 is secured to the main frame 551 to freely guide a carriage 555. A pin (not shown) that engages the spiral groove 553 is provided for the carriage 555, and as the lead screw 552 is rotated by the drive motor 559, the carriage 555 is reciprocally moved in the directions indicated by arrows a and b. A paper pressing plate 572 presses a recording medium 590 against a platen roller 573 in the direction in which the carriage 555 is moved.

The liquid discharge head cartridge 580 is mounted on the carriage 555. The liquid discharge head cartridge 580 is obtained by integrally forming the liquid discharge head of this invention and an ink tank. The liquid discharge head cartridge 580 is secured to the carriage 555 by positioning means and an electric contact point that are set for the carriage 555, and is detachable from the carriage 555.

Photocouplers 557 and 558 constitute home position detection means for identifying in this area the presence of a lever 556 of the carriage 555, and for rotating the drive motor 559 backward. A cap member 567, which caps the front end of a liquid discharge head 70 (the face whereat discharge orifices 5 open), is supported by a support member 562. Further, attraction means 566 is provided to perform the suction/recovery operation for the liquid discharge head 70 via a cap opening 568. A support plate 565 is attached to a main support plate 564, and a cleaning blade 563 that is slidably supported by the support plate 565 is moved forward and backward by drive means (not shown). The shape of the cleaning blade 563 is not limited to the one shown in FIG. 18, and a well known shape can be employed. A lever 570 is used to start the suction/recovery operation of the liquid discharge head 70. The lever 570 is moved as a cam 571 that contacts the carriage 555 as it is moved, and the driving force is transmitted from the drive motor 559 by well known transmission means, such as gear changer or latch changer.

The capping, cleaning and suction/recovery operations are performed at the corresponding locations by the action of the lead screw 552 when the carriage 555 is moved to the home position area. When a desired operation is set to be initiated in accordance with well known timing, this is applied to the embodiments.

The above described liquid discharge apparatus comprises recording signal supply means for transmitting, to the liquid discharge head, a recording signal to drive the electrothermal generating element of the liquid discharge head; and a controller for controlling the liquid discharge apparatus.

Since the above described liquid discharge head of this invention is mounted on the liquid discharge apparatus, ink ejection is stabilized, and as a result, a recording apparatus can be provided for which there is less image quality deterioration. In the above liquid discharge apparatus, the discharge head cartridge 580 is detachably mounted on the carriage 555; however, the liquid discharge head 70 may be integrally formed with the carriage 555, and only the ink tank may be detachable.

What is claimed is:

1. A liquid discharge head comprising:

an element substrate, on the surface of which a plurality of energy generation elements are arranged in parallel to generate electrical energy that is applied to eject a liquid;

a top plate, which is positioned facing said element substrate and which defines a plurality of liquid flow paths that correspond to said energy generation elements and that communicate with discharge orifices whereat a liquid is ejected;

one or more flow rate detection elements, which are provided for each of said liquid flow paths to detect the flow rate at which said liquid flows along each of said liquid flow paths; and an energy generation element controller for controlling, based on the results output by said flow rate detection elements, a condition under which said energy generation elements are driven, wherein said flow rate detection elements are provided on said liquid flow paths upstream of said energy generation elements.

2. A liquid discharge head according to claim 1, wherein said flow rate detection elements each include a heat generator and a temperature detector for flow rate detection.

3. A liquid discharge head according to claim 2, wherein said flow rate detection elements are thermistors.

4. A liquid discharge head according to claim 2, wherein the flow rate is detected by heating said heat generator before the application of the electrical energy, and by detecting a temperature using said temperature detector after the application of the electrical energy.

5. A liquid discharge head according to claim 4, wherein the electrical energy is applied as a plurality of pulses.

6. A liquid discharge head according to claim 2, wherein the condition for the driving of said energy generation elements is controlled for each of said liquid flow paths.

7. A liquid discharge head according to claim 6, wherein the condition for the driving of said energy generation elements is controlled by changing the pulse width of a drive pulse to be applied to each of said energy generation elements.

8. A liquid discharge head according to claim 1, wherein said energy generation elements are electro-thermal conversion elements that generate thermal energy for generating bubbles.

9. A liquid discharge head comprising:

an element substrate, on the surface of which a plurality of energy generation elements are arranged in parallel to generate electrical energy that is applied to eject a liquid;

a top plate, which is positioned facing said element substrate and which defines a plurality of liquid flow paths that correspond to said energy generation elements and that communicate with discharge orifices whereat a liquid is ejected;

one or more flow rate detection elements, which are provided for each of said liquid flow paths to detect the flow rate at which said liquid flows along each of said liquid flow paths; and an energy generation element controller for controlling, based on the results output by said flow rate detection elements, a condition under which said energy generation elements are driven, wherein the condition for driving said energy generation elements are controlled by driving sub-heaters that are provided for said liquid discharge head and heating the liquid in said liquid flow paths.

10. A liquid discharge head comprising:

an element substrate, on the surface of which a plurality of energy generation elements are arranged in parallel to generate electrical energy that is applied to eject a liquid;

a top plate, which is positioned facing said element substrate and which defines a plurality of liquid flow paths that correspond to said energy generation elements and that communicate with discharge orifices whereat a liquid is ejected;

one or more flow rate detection elements, which are provided for each of said liquid flow paths to detect the flow rate at which said liquid flows along each of said liquid flow paths; and an energy generation element controller for controlling, based on the results output by said flow rate detection elements, a condition under which said energy generation elements are driven, wherein said energy generation elements are electrothermal conversion elements that generate thermal energy for generating bubbles, and movable members are located along said liquid flow paths, facing said energy generation elements, so that the downstream ends of said movable members, which are directed toward said discharge orifices, move freely, and wherein said flow rate detection elements are provided for said movable members.

11. A liquid discharge head comprising:

an element substrate, on the surface of which a plurality of energy generation elements are arranged in parallel to generate electrical energy that is applied to eject a liquid;

a top plate, which is positioned facing said element substrate and which defines a plurality of liquid flow paths that correspond to said energy generation elements and that communicate with discharge orifices whereat a liquid is ejected;

one or more flow rate detection elements, which are provided for each of said liquid flow paths to detect the flow rate at which said liquid flows along each of said liquid flow paths; and an energy generation element controller for controlling, based on the results output by said flow rate detection elements, a condition under which said energy generation elements are driven, wherein said flow rate detection elements are provided for walls of a top plate facing the liquid flowing in said liquid flow paths.

12. A liquid discharge head comprising:

an element substrate, on the surface of which a plurality of energy generation elements are arranged in parallel to generate electrical energy that is applied to eject a liquid;

a top plate, which is positioned facing said element substrate and which defines a plurality of liquid flow paths that correspond to said energy generation elements and that communicate with discharge orifices whereat a liquid is ejected;

one or more flow rate detection elements, which are provided for each of said liquid flow paths to detect the flow rate at which said liquid flows along each of said liquid flow paths; and an energy generation element controller for controlling, based on the results output by said flow rate detection elements, a condition under which said energy generation elements are driven, wherein said flow rate detection elements are provided for walls of said element substrate facing the liquid flowing in said liquid flow paths.

13. A liquid discharge head comprising:

an element substrate, on the surface of which a plurality of energy generation elements are arranged in parallel to generate electrical energy that is applied to eject a liquid;

a top plate, which is positioned facing said element substrate and which defines a plurality of liquid flow paths that correspond to said energy generation elements and that communicate with discharge orifices whereat a liquid is ejected;

one or more flow rate detection elements, which are provided for each of said liquid flow paths to detect the flow rate at which said liquid flows along each of said liquid flow paths; and an energy generation element controller for controlling, based on the results output by said flow rate detection elements, a condition under which said energy generation elements are driven, wherein said flow rate detection elements are provided in three-dimensional structures that project outward into said liquid flow paths from walls that define said liquid flow paths.

14. A liquid discharge apparatus comprising:

transportation means for transporting a recording medium; and supporting means for supporting a liquid discharge head according to any one of claims 1 to 13, which ejects a liquid to record an image on said recording medium, and for reciprocally moving perpendicular to the direction in which the recording medium is transported.

15. A liquid discharge apparatus according to claim 14, further comprising:

recovery means for, in accordance with a signal output by each of said flow rate detection elements, performing a recovery process to suck the liquid in said liquid discharge head.

16. A method for correcting a volume of liquid discharged from a liquid discharge head, said head comprising:

an element substrate, on the surface of which a plurality of energy generation elements are arranged in parallel to generate electrical energy that is applied to eject a liquid, a top plate, which is positioned facing said element substrate and which defines a plurality of liquid flow paths that correspond to said energy generation elements and that communicate with discharge orifices whereat a liquid is ejected, one or more flow rate detection elements, which are provided for each of said liquid flow paths to detect the flow rate at which said liquid flows along each of said liquid flow paths, each of said flow rate detection elements including a heat generator for flow rate detection and a temperature detector, and an energy generation element controller, for controlling, based on the results output by said flow rate detection elements, a driving condition of said energy generation elements, said method comprising:

a heating step of driving the heat generator to heat the liquid in each of the liquid flow paths;

an ejection step of driving the energy generation elements after the heat generator has been activated, and of ejecting the liquid;

a detection step of, after the liquid has been ejected, employing the temperature detector to detect the temperature of the liquid near the flow rate detection element;

a calculation step of calculating a discharge volume based on the detected temperature; and a control step of employing the results obtained in said calculation step to control the condition for the driving of each of the energy generating elements, wherein, when it is ascertained from the results obtained in said calculation step that the liquid is not being ejected, a command for a recovery process is transmitted to the liquid discharge apparatus.

17. A method according to claim 16, wherein, when it is ascertained from the results obtained in said calculation step that the average discharge volume for the liquid flow paths is greater than a predetermined volume, the electrical energy applied to the liquid discharge head is reduced.

18. A method according to claim 16, wherein the electrical energy is applied as a plurality of pulses.

19. A method according to claim 16, wherein the condition for driving each of the energy generation elements is controlled for each of the liquid flow paths.

20. A method according to claim 19, wherein the condition for driving each of the energy generation elements is controlled by changing the width of a drive pulse that is to be transmitted to the energy generation elements.

21. A method for correcting a volume of liquid discharged from a liquid discharge head, said head comprising:

an element substrate, on the surface of which a plurality of energy generation elements are arranged in parallel to generate electrical energy that is applied to eject a liquid, a top plate, which is positioned facing said element substrate and which defines a plurality of liquid flow paths that correspond to said energy generation elements and that communicate with discharge orifices whereat a liquid is ejected, one or more flow rate detection elements, which are provided for each of said liquid flow paths to detect the flow rate at which said liquid flows along each of said liquid flow paths, each of said flow rate detection elements including a heat generator for flow rate detection and a temperature detector, and an energy generation element controller, for controlling, based on the results output by said flow rate detection elements, a driving condition of said energy generation elements, said method comprising:

a heating step of driving the heat generator to heat the liquid in each of the liquid flow paths;

an ejection step of driving the energy generation elements after the heat generator has been activated, and of ejecting the liquid;

a detection step of, after the liquid has been ejected, employing the temperature detector to detect the temperature of the liquid near the flow rate detection element;

a calculation step of calculating a discharge volume based on the detected temperature; and a control step of employing the results obtained in said calculation step to control the condition for the driving of each of the energy generating elements, wherein, when it is ascertained from the results obtained in said calculation step that the average discharge volume for the liquid flow paths is smaller than a predetermined volume, a sub-heater provided for the liquid discharge head is activated to heat the liquid in the liquid flow paths.

* * * * *